US008585174B2

(12) United States Patent
Saita

(10) Patent No.: US 8,585,174 B2
(45) Date of Patent: Nov. 19, 2013

(54) INKJET PRINTING APPARATUS AND PRINTING METHOD OF INKJET PRINTING APPARATUS

(75) Inventor: Hirofumi Saita, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 306 days.

(21) Appl. No.: 13/169,745

(22) Filed: Jun. 27, 2011

(65) Prior Publication Data

US 2011/0316925 A1 Dec. 29, 2011

(30) Foreign Application Priority Data

Jun. 28, 2010 (JP) ..... 2010-146656

(51) Int. Cl.
*B41J 29/393* (2006.01)

(52) U.S. Cl.
USPC ..... 347/19

(58) Field of Classification Search
USPC ..... 347/19
See application file for complete search history.

(56) References Cited

U.S. PATENT DOCUMENTS

| | | | | |
|---|---|---|---|---|
| 6,267,518 | B1 | 7/2001 | Abe | |
| 6,499,822 | B1 | 12/2002 | Abe et al. | |
| 6,905,186 | B2 * | 6/2005 | Kojima | 347/19 |
| 7,377,614 | B2 * | 5/2008 | Hatayama | 347/19 |
| 2002/0030704 | A1 | 3/2002 | Korngold et al. | |
| 2003/0030686 | A1 | 2/2003 | Abe et al. | |
| 2008/0019727 | A1 * | 1/2008 | Honma | 399/82 |
| 2009/0244167 | A1 | 10/2009 | Saita et al. | |
| 2009/0293750 | A1 * | 12/2009 | Haenni et al. | 101/484 |
| 2009/0318184 | A1 | 12/2009 | Azami et al. | |

FOREIGN PATENT DOCUMENTS

| | | | |
|---|---|---|---|
| DE | 198 40 381 | A1 | 3/2000 |
| EP | 2 127 892 | A1 | 12/2009 |
| JP | 10-166566 | A | 6/1998 |
| JP | 11-315484 | A | 11/1999 |
| JP | 2001-146006 | A | 5/2001 |
| JP | 2002-236015 | A | 8/2002 |
| JP | 2005-246650 | A | 9/2005 |
| JP | 2009-241499 | A | 10/2009 |
| JP | 2009-279821 | A | 12/2009 |
| JP | 2010-012757 | A | 1/2010 |

OTHER PUBLICATIONS

Extended European Search Report issued on Sep. 27, 2011 in corresponding European patent application No. 11171458.0-1251.
Japanese Office Action dated Oct. 1, 2013 issued in corresponding Japanese Patent Application No. 2010-146656 (English translation is provided).

* cited by examiner

*Primary Examiner* — Julian Huffman
(74) *Attorney, Agent, or Firm* — Birch, Stewart, Kolasch & Birch, LLP

(57) ABSTRACT

An inkjet printing apparatus includes: an inkjet head having nozzles which eject ink; a first conveyance device which moves at least one of an image formation medium and the inkjet head during image formation by the inkjet head; a second conveyance device which conveys the image formation medium along a conveyance path after the image formation by the inkjet head; an imaging device; a test pattern printing control device which controls ejection of the inkjet head; an ejection failure nozzle detection processing device; an expansion-contraction reference mark printing control device; an expansion-contraction deformation amount measurement device; an image deformation processing device which applies image deformation processing corresponding to the amount of deformation due to expansion and contraction, to image data to be printed on the second surface; and a print control device which carries out the printing on the second surface on a basis of the image data which has been corrected through the image deformation processing.

10 Claims, 14 Drawing Sheets

INKJET PRINTING APPARATUS AND PRINTING METHOD OF INKJET PRINTING APPARATUS

BACKGROUND OF THE INVENTION

1. Field of the Invention

The present invention relates to an inkjet printing apparatus, and more particularly to technology for improving positional deviation between front and rear surface images produced by double-side printing.

2. Description of the Related Art

When performing double-side printing by an offset printing machine using a printing plate, normally, after printing on a front surface with trim marks, the paper is inverted and the rear surface printing is carried out, whereupon an operator looks through the resulting output printed object, or performs an inspection by passing a needle therethrough, and the tension of printing plate is adjusted, and the like, on the basis of the inspection results, so as to align the positions of the rear and front surfaces. In the case of an offset printer, since there is a small amount of water in the ink compared to aqueous inkjet printing, then there has been virtually no problem of deformation of the paper due to expansion and contraction in relation to the image density (ink volume).

On the other hand, with an inkjet printer which uses water-soluble ink, there is a large amount of water contained in the ink, and therefore the paper expands and contracts, depending on the ink volume (image density) adhering to the paper, and the difference between the front and rear surface positions in the printed image on the rear surface (positional deviation between the front and rear images) becomes large, which is a disadvantage compared to the offset printing.

In respect of image position alignment technology, Japanese Patent Application Publication No. 2009-279821 discloses a line type inkjet printing apparatus which detects deviation in the paper width direction caused by the previous printing operation, by means of a paper position sensor, and moves the position of image data. Japanese Patent Application Publication No. 2010-12757 discloses a printer apparatus in which a reference mark is also printed when printing on the front surface, the reference mark on the rear side surface (printed surface) are detected when printing on the rear surface, and the printing position of image data for rear surface printing is corrected. Furthermore, Japanese Patent Application Publication No. 2002-236015, Japanese Patent Application Publication No. 2001-146006, Japanese Patent Application Publication No. 11-315484 and Japanese Patent Application Publication No. 10-166566 each disclose a method in which a reference image mark is formed in advance and printing is performed from both the front and rear surfaces so as to be aligned with the reference image mark.

However, in the case of aqueous inkjet printing, there is great deformation of the paper dimensions, depending on the storage time and storage environment after printing on the front surface (first surface), and there has been no simple method for aligning the image positions on the front and rear surface images, which is appropriate in respect of paper deformation of this kind.

Furthermore, in a method which records a reference mark only on a front surface, as proposed in the related art, the accuracy of measurement of the amount of deformation of the paper is limited by the resolution of the imaging system which determines the amount of deformation.

SUMMARY OF THE INVENTION

The present invention has been contrived in view of these circumstances, an object thereof being to provide an inkjet printing apparatus and an inkjet printing method, whereby positional deviation between front and rear surface images can be improved, even if there are many different types of paper, variations in the ambient storage conditions or the storage time after printing on the front surface.

Apart from the object stated above, it is a further object of the present invention to provide technology for achieving positional alignment between front and rear surface images by means of a simple mechanism, and moreover to enable the amount of expansion and contraction of the paper to be measured with an accuracy (resolution) exceeding the resolution of the imaging system.

The following modes of the invention are given in order to achieve an aforementioned object.

One aspect of the invention is directed to an inkjet printing apparatus comprising: an inkjet head having nozzles which eject ink; a first conveyance device which moves at least one of an image formation medium and the inkjet head during image formation by the inkjet head so as to causes relative movement of the image formation medium and the inkjet head; a second conveyance device which conveys the image formation medium along a conveyance path after the image formation by the inkjet head; an imaging device which is disposed in the conveyance path and captures an image of a print result recorded on the image formation medium; a test pattern printing control device which controls ejection of the inkjet head in such a manner that an inspection test pattern for inspecting ejection quality of the inkjet head is recorded on the image formation medium; an ejection failure nozzle detection processing device which identifies a position of an ejection failure nozzle of the inkjet head on a basis of information obtained by capturing an image of a print result of the inspection test pattern by the imaging device; an expansion-contraction reference mark printing control device which controls ejection of the inkjet head so as to record expansion-contraction reference marks that form reference points for measuring a distance between at least two points, in a periphery outside an image forming region of a first surface of the image formation medium, when printing is performed on the first surface; an expansion-contraction deformation amount measurement device which obtains information indicating an amount of deformation due to expansion and contraction of the image formation medium, from information obtained by conveying, by the second conveyance device, at least one sheet of a first surface-printed image formation medium whose first surface has already been printed, prior to printing on a second surface which is a rear surface of a print object obtained by the printing on the first surface, and capturing, by the imaging device, an image of the expansion-contraction reference marks recorded on the first surface of the at least one sheet of the first surface-printed image formation medium, when the printing is performed on an image forming region of the second surface after the printing on the first surface; an image deformation processing device which applies image deformation processing corresponding to the amount of deformation due to expansion and contraction, to image data to be printed on the second surface, on a basis of the information indicating the amount of deformation due to expansion and contraction; and a print control device which carries out the printing on the second surface on a basis of the image data which has been corrected through the image deformation processing.

According to this aspect of the invention, when the second surface is printed after printing the first surface, the amount of deformation due to expansion and contraction of the first surface-printed image formation medium is measured, and processing is carried out for deforming the image data for printing on the second surface (expansion and contraction correction processing), in accordance with this amount of deformation due to expansion and contraction. Therefore, suitable printing of the second surface is possible. According to this aspect of the invention, it is possible to improve positional deviation between the front and rear surface images in double-side printing.

By measuring the amount of deformation due to expansion and contraction when printing on the second surface is started (and more desirably, immediately before starting the printing on the second surface), it is possible to perform correction of the state of the image appropriately, even if there is variation in the type of paper or the ambient storage conditions and the storage time after printing on the first surface.

Furthermore, according to this aspect of the present invention, it is possible to measure the amount of expansion and contraction of the first surface-printed image formation medium by using an imaging device which is used for detecting ejection failure nozzles, and hence there is no need to provide a dedicated sensor. The imaging device desirably uses a mode employing an imaging device in which a lot of photoelectric transducer elements (photosensors) are arranged in an array at a uniform pitch.

The information acquired by inspection of ejection quality may be information relating to the ejection characteristics of the respective nozzles, such as the presence or absence of ejection (ejection/non-ejection), landing position error, ejected droplet volume error, output density, and the like.

The investigation test pattern printed on the image formation medium is read in by the imaging device (image reading device), and by analyzing and processing this image signal, it is possible to identify ejection failure nozzles (not only nozzles which are blocked, but also nozzles that may include defective nozzles suffering landing position abnormality or ejected droplet volume abnormality which are disabled for ejection). A desirable mode is one where an image correction device (ejection failure correction processing device) is provided in order to compensate for the output of ejection failure nozzles by means of other normally functioning nozzles apart from the ejection failure nozzles, on the basis of the information about ejection failure nozzles identified from the print results of the investigation test pattern.

For example, the occurrence or non-occurrence of abnormal nozzles is monitored constantly while forming a test pattern for abnormal nozzle determination (an inspection test pattern) in the non-image region (so-called blank margin portion) of an image formation medium, during a process of continuously recording desired print images (continuous printing). In a case where an abnormal nozzle (an ejection failure nozzle or a defective nozzle which may become an ejection failure) has been determined in this monitoring during printing, a test pattern for density non-uniformity correction is desirably formed in the non-image region of the recording medium, in order to acquire density data required for correction processing to improve the effects of disabling the ejection of the abnormal nozzle. Therefore, the test pattern for density non-uniformity correction is read and image data is corrected in such a manner that a required image quality can be achieved by using only nozzles other than the abnormal nozzle, on the basis of the reading results. Ink ejection control data (droplet ejection control data) is generated on the basis of the corrected image data obtained in this way, and recording of a print image is performed in accordance with the ink ejection control data.

In this aspect of the present invention, as a device for carrying out double-side printing efficiently, it is possible to add an apparatus which inverts the front/rear surfaces of a whole paper stack together, the paper stack being constituted by a plurality of sheets of paper which have completed printing on the first surface and have been stacked on top of each other. The direction of rotation for inverting the vertical orientation (front/rear surfaces) of the stack of paper may be either a direction of inverting the top/bottom of the paper or a direction of inverting the left/right-hand side of the paper.

If a stack of a plurality of first surface-printed image formation media piled on top of each other is inverted in terms of the front/rear surfaces all together, then before starting printing on the second surfaces, a prescribed number of sheets of the inverted stack of paper including at least the first sheet (for example, if a stack of paper is obtained by stacking up printed paper in output order, then the sheet of paper on which first surface-printed has been carried out first, of the stack of paper) are inverted again in terms of the front/rear surfaces (namely, are returned to the same front/rear surface orientation as when printing the first surface), and are set in the printing apparatus.

Desirably, the expansion-contraction reference marks are formed in four corners of the image forming region.

In general printing, a rectangular paper is used as an image formation medium, and the image area (image forming region) where a desired print image is recorded is often a rectangular shape also. For the reference points (measurement points) for measuring the amount of expansion and contraction of the paper, it is desirable to use the four corner points of the image forming region (four points), and to record expansion-contraction reference marks in these four corners, at the least.

The expansion-contraction reference marks may adopt various modes, such as cross-lines (a cross-shaped pattern) comprising an intersection of a longitudinal line and a lateral line, straight lines (segments), points, or the like. This aspect of the invention is not limited to a mode where one reference point is recorded by one expansion-contraction reference mark, and it is also possible to identify two reference points by means of one expansion-contraction reference mark. For example, a mode is possible in which the respective end positions of one line segment are taken respectively as measurement points (a mode where one line segment having both ends forming two measurement points is used as an expansion-contraction reference mark).

Desirably, the first conveyance device is a medium conveyance device which moves the image formation medium in cut sheet form.

A possible mode of the unprinted image formation medium is cut sheet (flat) or continuous paper (rolled paper, wound paper), but desirably, at least the image formation medium after first surface printing is a cut sheet medium which is separated into individual sheets. This aspect of the present invention is suitable for a cut sheet printer. This aspect of the present invention may also be applied to a mode where paper is supplied as continuous paper in first surface printing, and the paper is cut to a prescribed size either before first surface printing or after first surface printing.

Desirably, the inkjet head is a line type head based on a single-pass method.

The printing method of the inkjet printing apparatus may be based on a single-pass method or a multi-pass method, and the present invention may be applied to either of these methods, but a single-pass method has higher productivity (a faster printing speed) than a multi-pass method since image formation at a prescribed recording resolution is carried out in one image formation scanning action, onto the image forming region of the image formation medium. A particularly desirable mode is one where the present invention is applied to an inkjet printing apparatus based on a single-pass method in which high productivity is required.

Desirably, the image deformation processing device applies the image deformation processing to the image data before half-tone processing.

A desirable mode is one where the image deformation processing (deformation due to expansion and contraction processing) corresponding to the deformation due to expansion and contraction of the image formation medium caused by first surface printing is applied to image data before half-tone processing, for example, image data of 8 bits for each color (256 tones).

Desirably, without performing the image formation by the inkjet head, the at least one sheet of the first surface-printed image formation medium is conveyed by the first conveyance device and the second conveyance device and image capture of the expansion-contraction reference marks is performed by the imaging device.

According to this aspect of the invention, it is possible to acquire positional information for an expansion-contraction reference mark with the accuracy of resolution of the imaging device (reading resolution).

Desirably, the inkjet printing apparatus further comprises an expansion-contraction reference mark additional printing control device which implements control for supplying the at least one sheet of the first surface-printed image formation medium to an image formation unit of the inkjet head, prior to the printing on the second surface, and causing the inkjet head to record new expansion-contraction reference marks additionally on the at least one sheet of the first surface-printed image formation medium, wherein the information indicating the amount of deformation due to expansion and contraction of the image formation medium is obtained from information obtained by conveying the at least one sheet of the first surface-printed image formation medium on which the new expansion-contraction reference marks have been additionally recorded, by the second conveyance device, and capturing an image of the expansion-contraction reference marks and the new expansion-contraction reference marks recorded on the first surface of the at least one sheet of the first surface-printed image formation medium, by the imaging device.

According to this aspect of the invention, it is possible to measure the amount of expansion and contraction from the difference between the positions of the first expansion-contraction reference marks recorded during first surface printing (called "first expansion-contraction reference marks") and the second expansion-contraction reference marks recorded additionally before starting second surface printing (called "second expansion-contraction reference marks").

Desirably, the inspection test pattern includes line patterns for the respective nozzles of the inkjet head whereby an ejection result of each nozzle can be identified and distinguished from other nozzles on the image formation medium; and the inspection test pattern is recorded in a blank margin portion outside the image forming region of the first surface, the at least one sheet of the first surface-printed image formation medium on which an image for printing has been printed in the image forming region of the first surface is supplied to the image formation unit of the inkjet head prior to the printing on the second surface, the new expansion-contraction reference marks are recorded additionally on the first surface of the at least one sheet of the first surface-printed image formation medium, and the amount of deformation due to expansion and contraction of the image formation medium is then measured in units of a nozzle pitch corresponding to a recording resolution of the inkjet head, by using information about pixel values of the inspection test pattern obtained by capturing an image of the inspection test pattern, the expansion-contraction reference marks, and the new expansion-contraction reference marks recorded on the first surface of the image formation medium.

According to this aspect of the invention, the inspection test pattern formed by an inkjet head having a recording resolution higher than the resolution of the imaging device (the pixel pitch on the paper) is used as a measurement scale, and by associating the positions of the nozzles which form an investigation test pattern with the positions of the expansion-contraction reference marks, it is possible to determine the amount of deformation due to expansion and contraction at a resolution close to the resolution of the recording nozzle pitch.

Desirably, positions of nozzles corresponding to positions of the additionally recorded new expansion-contraction reference marks are identified from a correlation between a pixel value of a signal obtained by capturing an image of the new expansion-contraction reference marks, and a pixel value of a signal obtained by capturing an image of the inspection test pattern, and positional information of the new expansion-contraction reference marks is obtained from the recording resolution and the positions of the nozzles.

Desirably, the inkjet printing apparatus further comprises a conveyance speed control device which makes a conveyance speed of the at least one sheet of the first surface-printed image formation medium when the image of the expansion-contraction reference marks on the first surface is captured by the imaging device while the at least one sheet of the first surface-printed image formation medium is conveyed, slower than a conveyance speed of the at least one sheet of the first surface-printed image formation medium during the printing on the first surface and a conveyance speed of the at least one sheet of the first surface-printed image formation medium during the printing on the second surface.

By reducing the conveyance speed during imaging of the expansion-contraction reference marks and raising the reading resolution in the conveyance direction, it is possible to improve the measurement accuracy of the expansion-contraction reference marks in the conveyance direction.

Another aspect of the invention is directed to a printing method of an inkjet printing apparatus including an inkjet head having nozzles for ejecting ink, a first conveyance device which moves at least one of an image formation medium and the inkjet head to cause relative movement of the image formation medium and the inkjet head during image formation by the inkjet head, a second conveyance device which conveys the image formation medium along a conveyance path after the image formation by the inkjet head, and an imaging device which is disposed in the conveyance path and captures an image of a print result formed on the image formation medium, the printing method comprising: a test pattern printing step of recording an inspection test pattern for inspecting ejection quality of the inkjet head, on the image formation medium; an ejection failure nozzle detection processing step of identifying a position of an ejection failure nozzle of the inkjet head on a basis of information obtained by capturing an image of a print result of the inspection test pattern by the imaging device; an expansion-contraction reference mark printing step of recording expansion-contraction reference marks that form reference points for measuring a distance between at least two points, in a periphery outside an image forming region of a first surface of the image formation medium, when printing is performed on the first surface; a first surface image printing step of carrying out the printing on an image forming region of the first surface; an expansion-contraction reference mark imaging step of conveying, by the second conveyance device, at least one sheet of a first surface-printed image formation medium whose first surface has already been printed prior to printing on a second surface which is a rear surface of a print object obtained by the printing on the first surface, and capturing, by the imaging device, an image of the expansion-contraction reference marks recorded on the first surface of the at least one sheet of the first surface-printed image formation medium, when the printing is performed on an image forming region of the second surface after the printing on the first surface; an expansion-contraction deformation amount measurement step of obtaining information indicating an amount of deformation due to expansion and contraction of the image formation medium from information obtained in the expansion-contraction reference mark imaging step; an image deformation processing step of applying image deformation processing corresponding to the amount of deformation due to expansion and contraction, to image data to be printed on the second surface, on a basis of the information indicating the amount of deformation due to expansion and contraction; and a second surface image printing step of performing the printing on the image forming region of the second surface on a basis of the image data which has been corrected through the image deformation processing.

As an example of the composition of a print head (recording head) used in an inkjet printing apparatus, it is possible to use a full-line type head (page-wide head) having a nozzle row in which a plurality of ejection ports (nozzles) are arranged through a length of not less than the full width of the image formation medium, by joining together a plurality of head modules. A full line type head of this kind is normally arranged in a direction perpendicular to the relative feed direction of the image formation medium (paper) (the relative conveyance direction), but a mode is also possible in which a head is arranged in an oblique direction forming a certain prescribed angle with respect to the direction perpendicular to the conveyance direction.

The "image formation medium" is a medium which receives deposition of droplets ejected from ejection ports of the head (the medium may also be called a print medium, an image formation medium, a recording medium, an image receiving medium, or the like), and includes various media regardless of material or shape, such as continuous paper, cut paper, sealed paper, cloth, fiber sheet, resin sheet, and the like. However, the present invention provides technology that is especially effective in the case of material which is liable to deformation due to expansion and contraction, such as a paper medium.

The conveyance device which relatively moves an image formation medium and a head in a relative manner also includes a mode which conveys an image formation medium with respect to a stationary (fixed) head, a mode which moves a head with respect to a stationary image formation medium, or a mode which moves both a head and an image formation medium. If forming a color image by using a print head based on an inkjet method, it is possible to arrange heads for the respective colors of inks (recording liquids) of a plurality of colors, or to adopt a composition where inks of a plurality of colors can be ejected from one recording head.

According to the present invention, it is possible to improve positional deviation between front and rear surface images, even if there is variation in the type of image formation medium, the ambient storage conditions and the storage time after front surface printing, and the like. Furthermore, since the amount of expansion and contraction of the image formation medium can be measured using an imaging device which is used for ejection failure detection, then this can be achieved by means of a simple composition, without requiring the addition of a dedicated sensor, or the like, for measurement purposes.

BRIEF DESCRIPTION OF THE DRAWINGS

A preferred embodiment of this invention as well as other objects and benefits thereof, will be explained in the following with reference to the accompanying drawings, in which like reference characters designate the same or similar parts throughout the figures and wherein.

Figure 2:
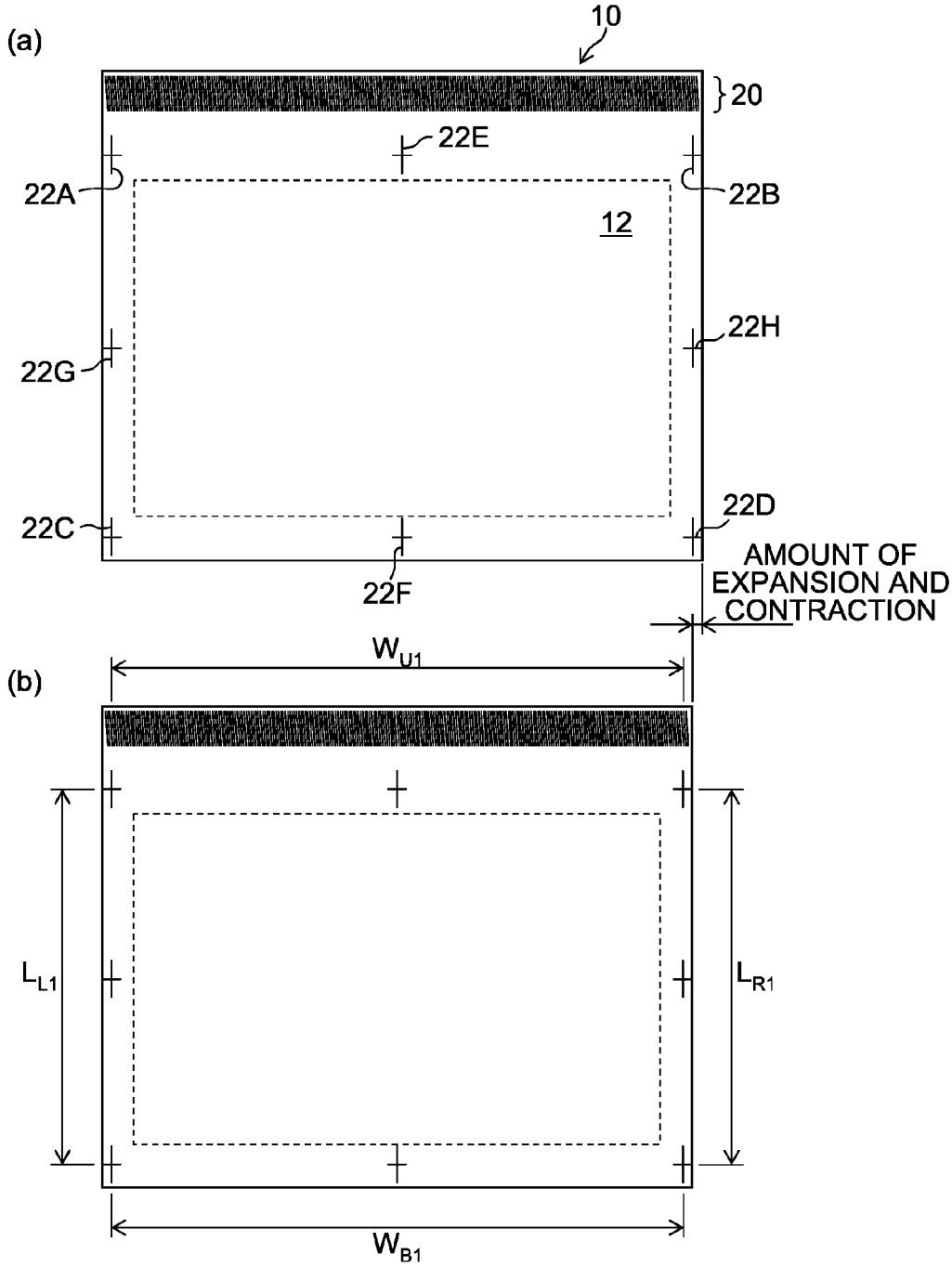
Figure 3:
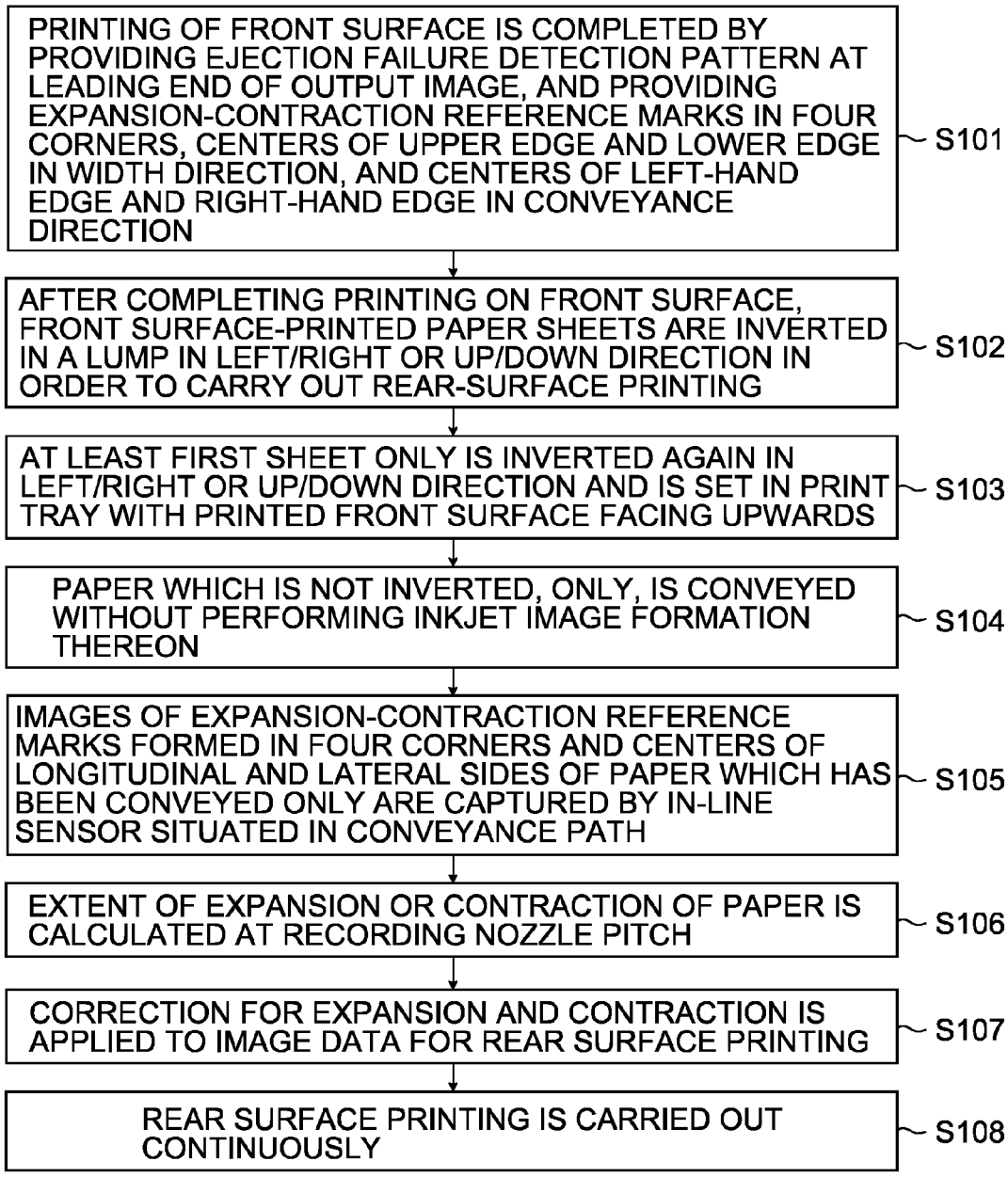
Figure 4:
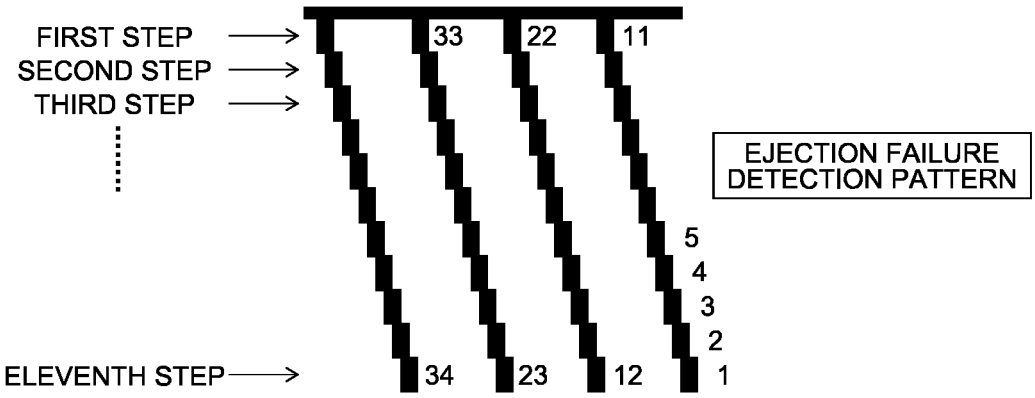
Figure 5:
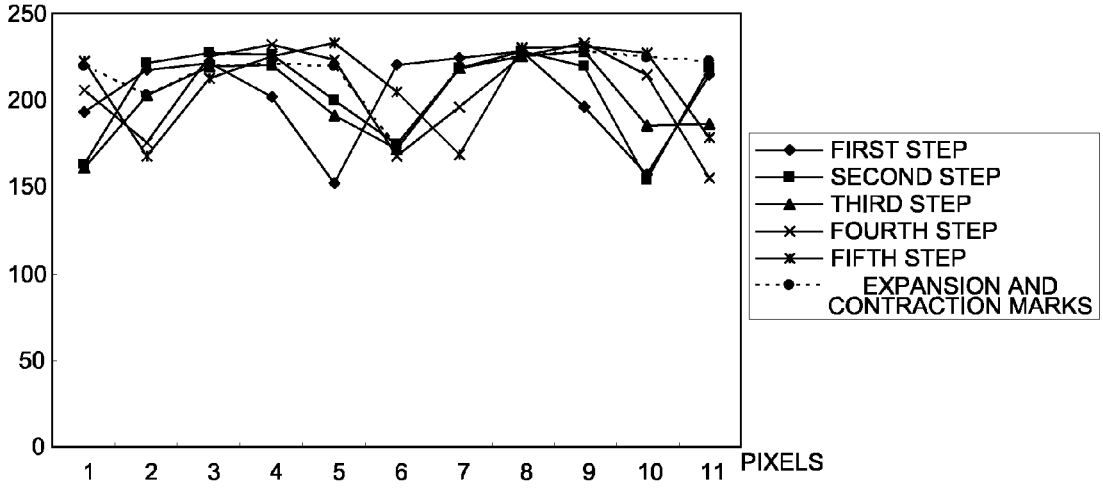
Figure 6:
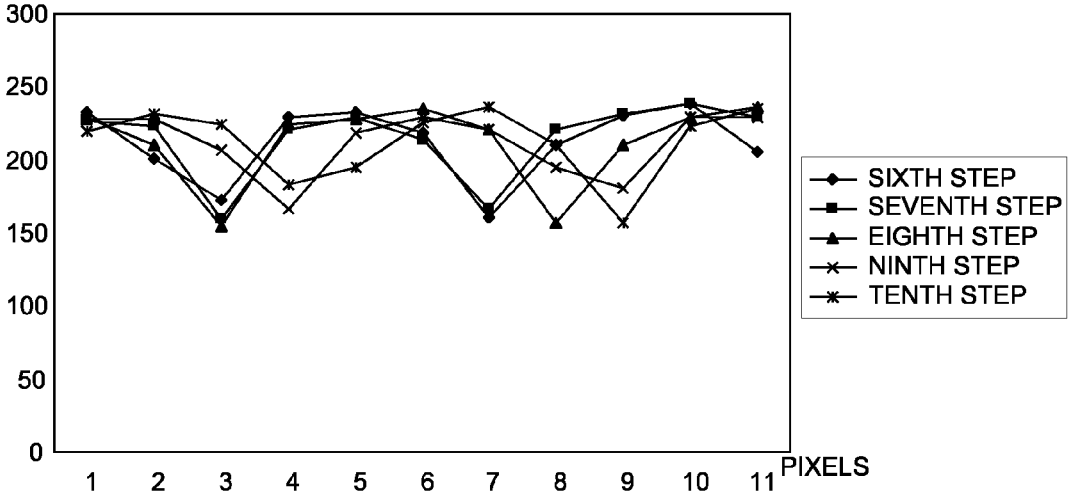
Figure 7:
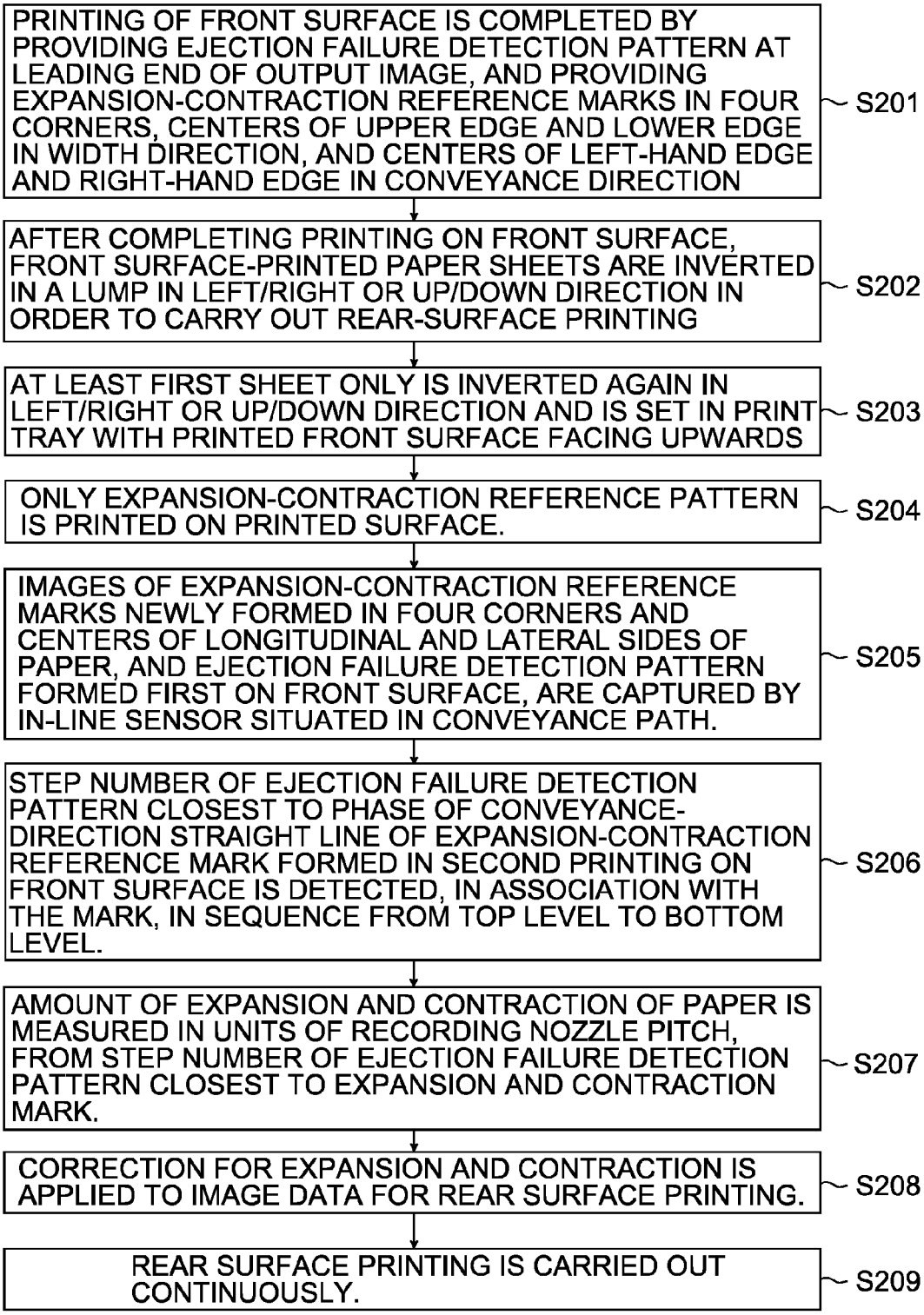
Figure 8:
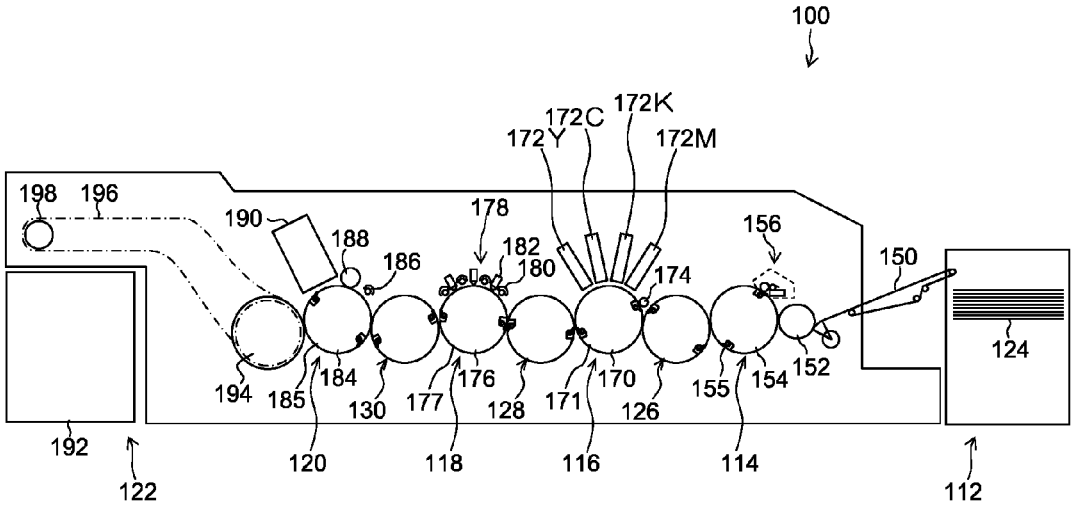
Figure 9A:
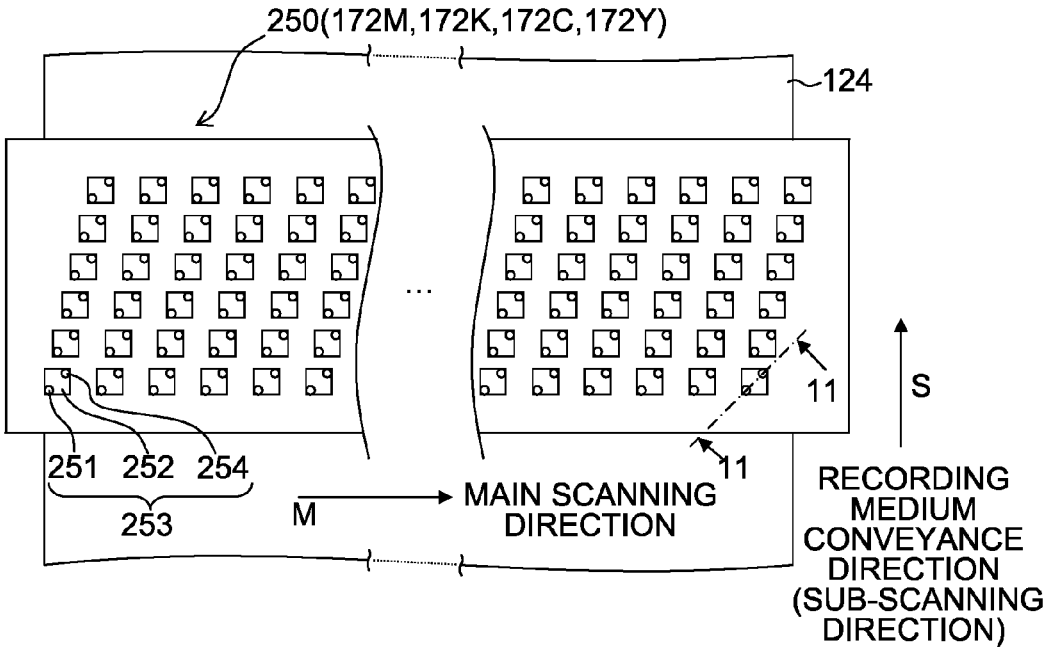
Figure 9B:
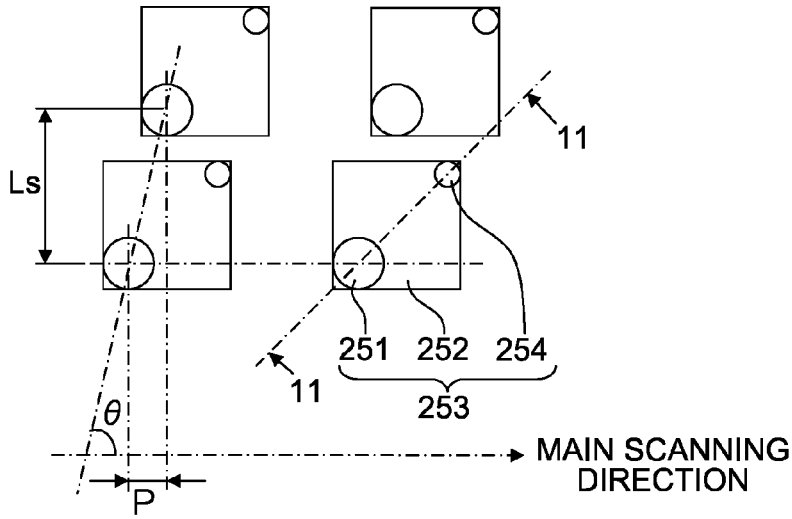
Figure 10A:
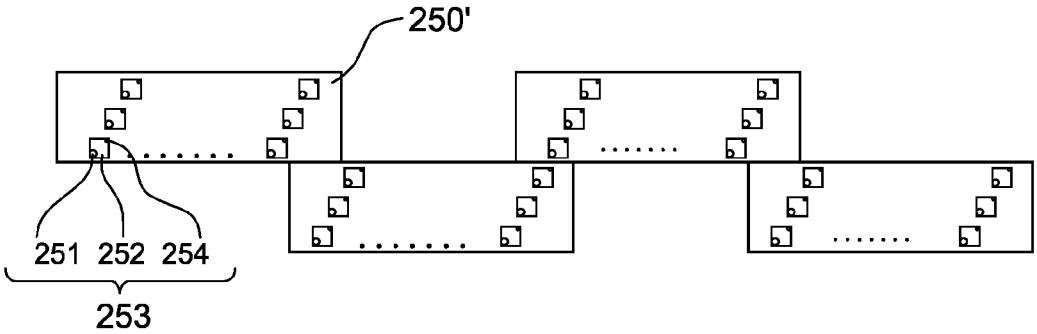
Figure 10B:
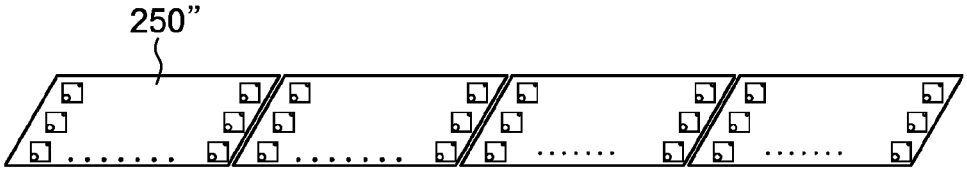
Figure 11:
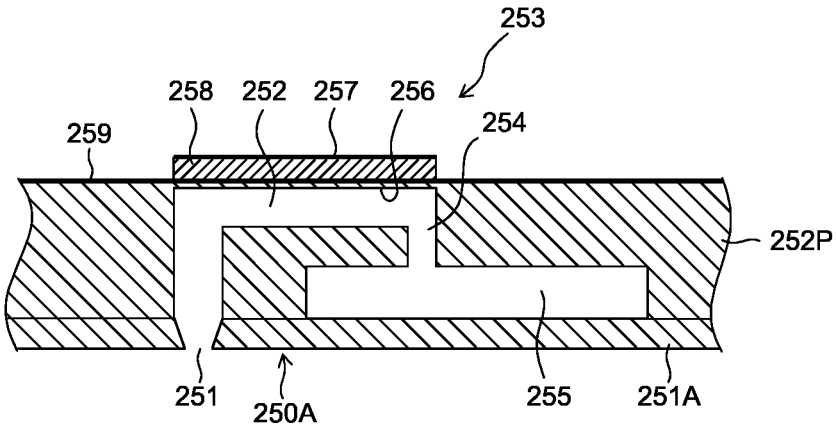
Figure 12:
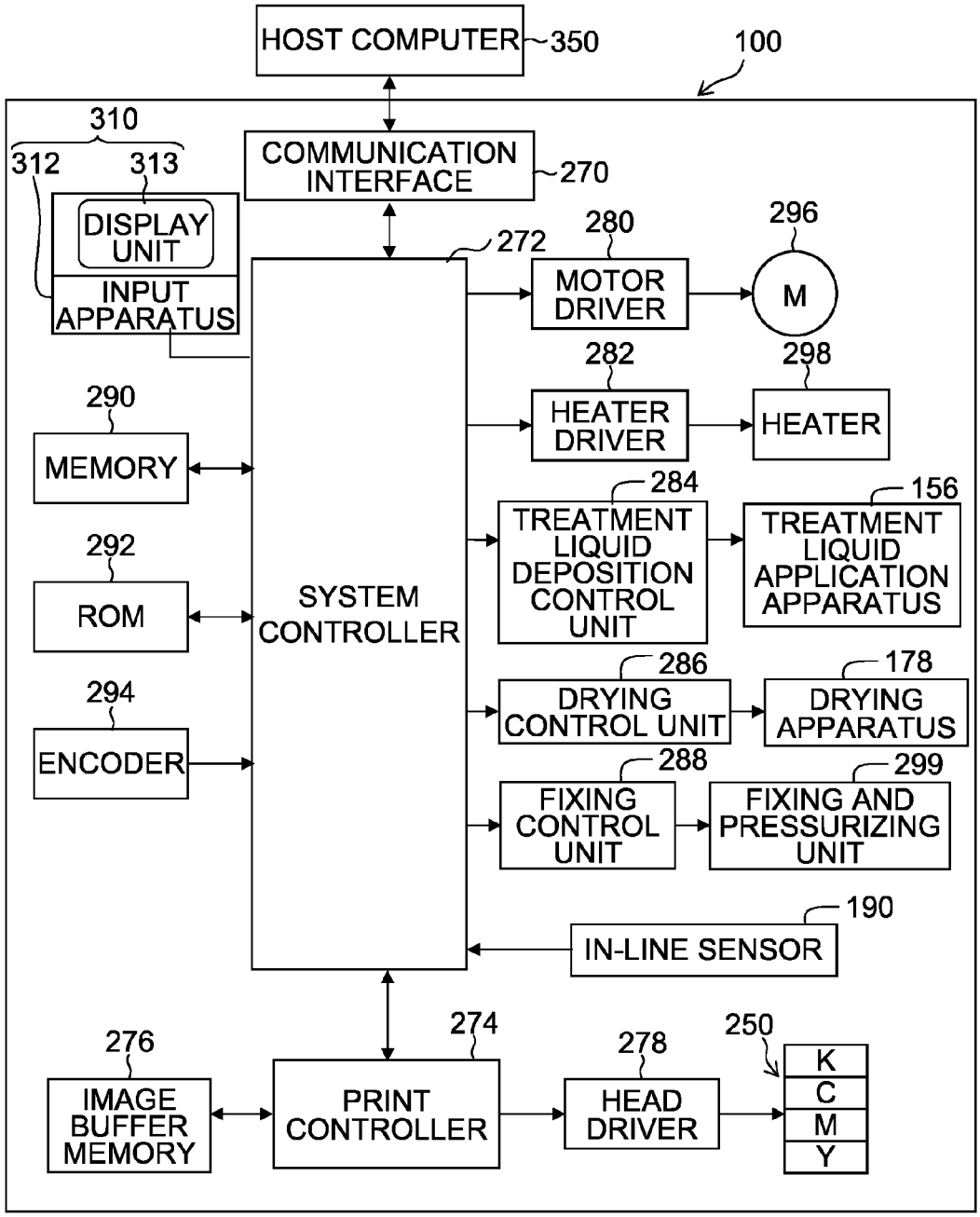
Figure 13:
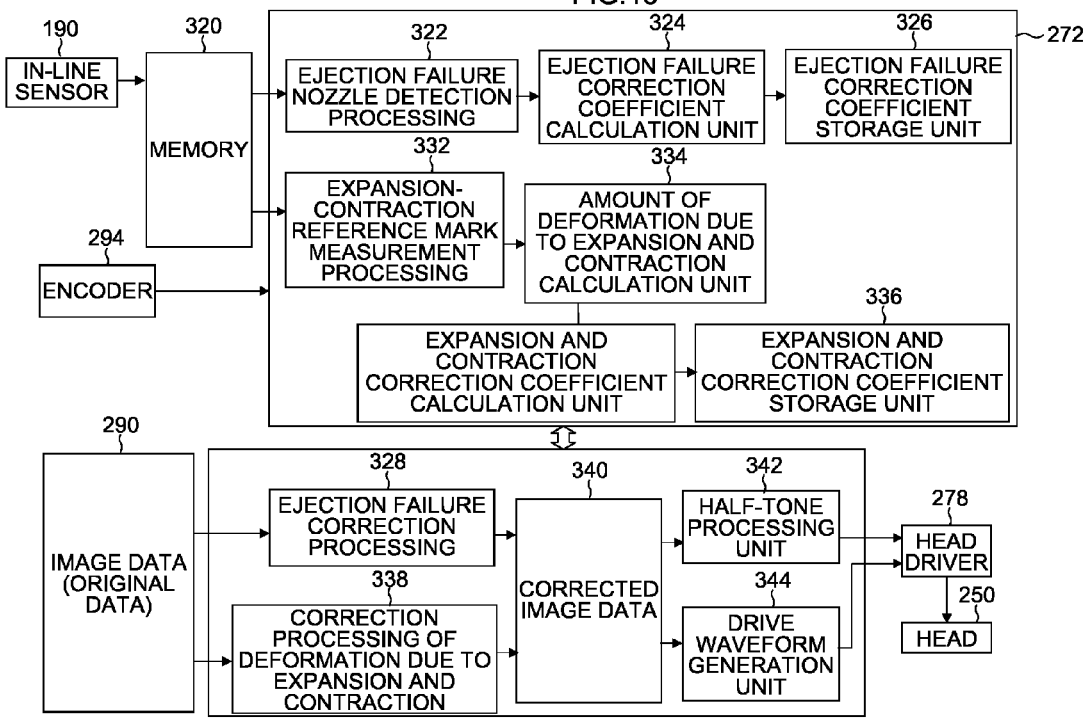
Figure 14:
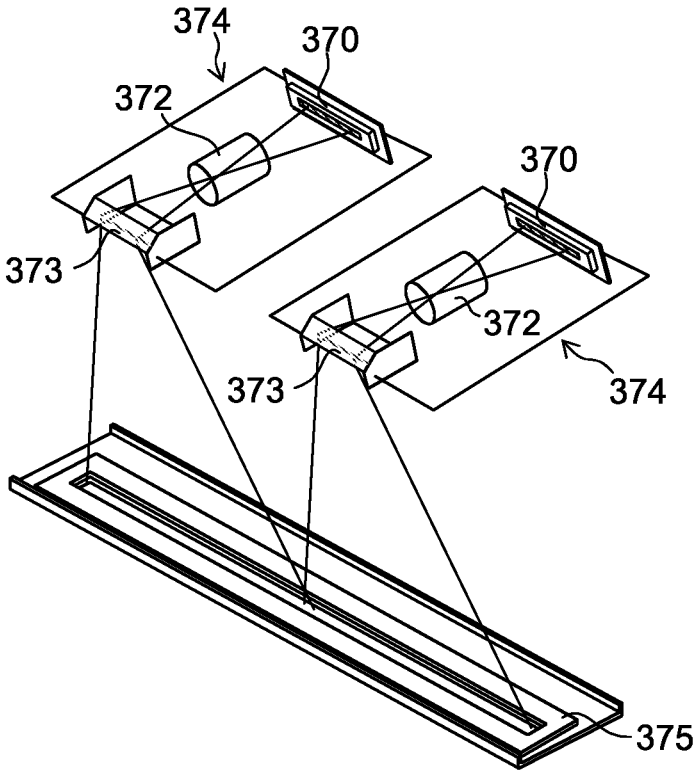

(*a*) and (*b*) of FIG. 2 are illustrative diagrams showing paper which has contracted in the time period from front surface printing to the start of rear surface printing;

FIG. 3 is a flowchart showing a sequence of a printing method according to a first embodiment;

FIG. 4 is an enlarged diagram showing one example of a "1-on n-off" type of ejection failure detection pattern;

FIG. 5 is a graph of the pixel values obtained by capturing an image of each of the first-step to fifth-step line blocks of an ejection failure detection pattern and the expansion-contraction reference marks;

FIG. 6 is a graph of the pixel values obtained by capturing an image of each of the sixth-step to tenth-step line blocks of an ejection failure detection pattern;

FIG. 7 is a flowchart showing a sequence of a printing method according to a second embodiment;

FIG. 8 is a schematic drawing of an inkjet printing apparatus relating to an embodiment of the present invention;

FIGS. 9A and 9B are plan view perspective diagrams showing an example of the structure of a head;

FIGS. 10A and 10B are plan view perspective diagrams showing examples of a structure of a line type head constituted by arranging a plurality of head modules;

FIG. 11 is a cross-sectional diagram along line 11-11 in FIGS. 9A and 9B;

FIG. 12 is a block diagram showing the composition of a control system of an inkjet printing apparatus;

FIG. 13 is a principal block diagram showing the main composition relating to ejection failure correction and correction for expansion and contraction; and FIG. 14 is a perspective diagram showing an example of the composition of an in-line sensor.

DETAILED DESCRIPTION OF THE PREFERRED EMBODIMENTS

An inkjet printing apparatus relating to an embodiment of the present invention is a drop-on-demand type printer based on a single-pass method fitted with a page-wide inkjet bar head (line head), and an in-line sensor which captures an image of image formation results is provided at a prescribed position (inspection point) in a conveyance path along which paper is conveyed after the image formation.

The in-line sensor (ILS) is composed by an imaging device having a prescribed reading resolution. For example, a CCD in-line sensor having an imaging range covering the whole width of a paper at a prescribed pixel pitch in the paper width direction is used. The in-line sensor reads in a test pattern or density pattern for detecting ejection failure (nozzle blockage), expansion/contraction reference marks, an output image (actual image for a printing object), and the like, which have been recorded on a paper.

Figure 1:
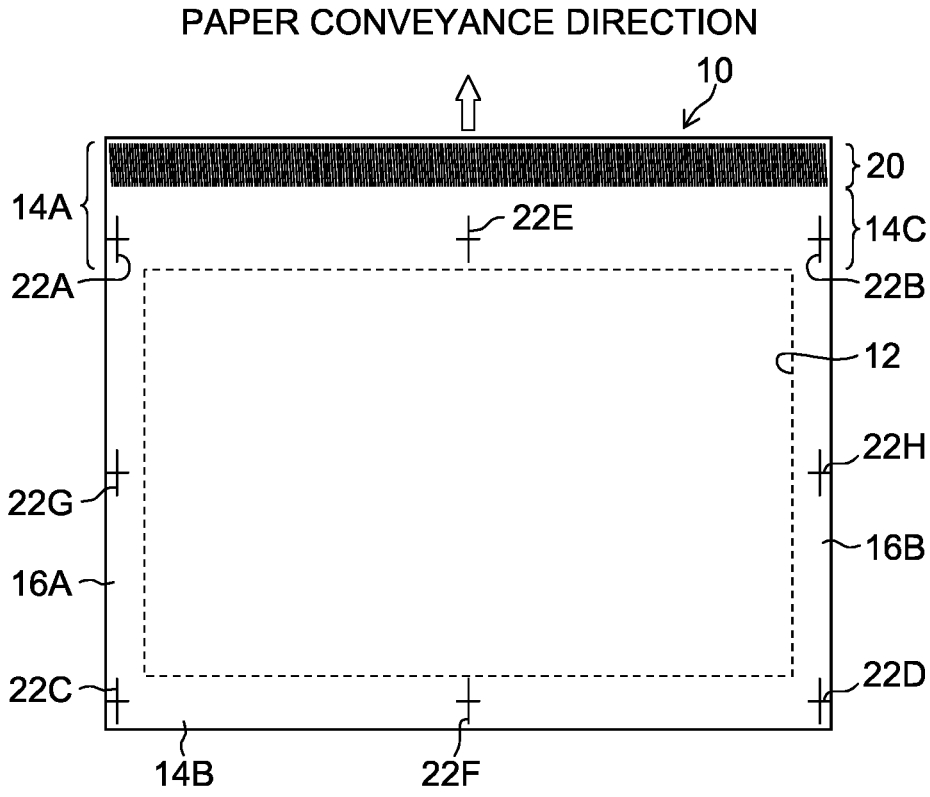
FIG. 1 is a plan diagram showing an example of an ejection failure detection pattern and expansion-contraction reference marks which are recorded during front surface printing by an inkjet printing apparatus relating to an embodiment of the present invention.

FIG. 1 is a plan diagram illustrating one example of print results (front surface printing) output by an inkjet printing apparatus relating to an embodiment of the present invention. The upward direction in FIG. 1 is the direction of conveyance of the paper 10, and the region surrounded by the rectangular broken line is an image forming region 12. The image forming region 12 is a region where a desired image for printing is formed. The image forming region 12 may also be called "image formation area" or "image area".

Blank margin portions (which may also be called "non-image forming regions" or "non-image areas") 14A, 14B, 16A, 16B are formed about the outer perimeter of the image forming region 12. In the present embodiment, an investigation test pattern 20 (hereinafter, called "ejection failure detection pattern") for detecting ejection failure nozzles is recorded in the blank margin portion 14A on the upper side of the paper 10 (i.e. on the leading end side in terms of the conveyance direction). Furthermore, expansion-contraction reference marks 22A, 22B, . . . , 22H are recorded in the blank margin portion 14C between the ejection failure detection pattern 20 in the blank margin portion 14A and the image forming region 12, and in the blank margin portion 14B on the trailing end side of the paper and the blank margin portions 16A and 16B on the left and right-hand sides of the paper. Below, these expansion-contraction reference marks 22A to 22H may be denoted jointly by the reference numeral 22.

The expansion-contraction reference marks 22 are marks forming measurement reference points (measurement points) for measuring the amount of deformation due to expansion and contraction of the paper, and in the present embodiment, the expansion-contraction reference marks 22 are recorded in the four corners (22A to 22D) of the image forming region 12, a central position (22E) in the width direction of the upper end of the image forming region 12, a central position (22F) in the width direction of the lower end of the image forming region 12, and respective lateral central positions (22G, 22H) in the conveyance direction at the left-hand end and right-hand end of the image forming region 12. The expansion-contraction reference marks 22 according to the present embodiment each use a cross-shaped mark including a longitudinal line and a lateral line, and the longitudinal line following the paper conveyance direction (called the "y direction") located at a position in the paper width direction intersects with the lateral line following the paper width direction perpendicular to the paper conveyance direction (called the "x direction"). By using cross-shaped marks of this kind, the positions in the x direction and the y direction on the paper can be ascertained readily.

In normal printing, a special test pattern (an ejection failure detection pattern 20) for detecting ejection failure nozzles and other defective nozzles, among the nozzle group of the inkjet bar head, is output onto the blank margin portion 14A of the paper 10, and the print result is read in by the in-line sensor. The ejection failure nozzle numbers are identified by signal processing (ejection failure detection processing) for identifying the ejection failure nozzle positions from the read image information acquired via the in-line sensor. Deterioration in image quality (white banding, density non-uniformities) caused by the ejection failure nozzles are corrected on the basis of the ejection failure nozzle information, and image correction processing is carried out so that white banding, and the like, caused by the ejection failure nozzles is not readily visible.

In an inkjet printer which has an in-line sensor as described above and is based on a single-pass method according to which image formation is performed in a lump by means of one relative scanning (movement) by a page-wide line head in the paper width direction, when performing double-side printing, firstly, printing is carried out on the front surface (first surface) to obtain a printed object such as that shown in FIG. 1, and printing is then carried out on the rear surface (second surface) of the printed object.

If carrying out double-side printing on a plurality of sheets, a stack of paper sheets which have completed printing on a front surface (front surface-printed paper) is inverted in the front/rear direction (turned upside-down) and set in a paper supply unit of the printer, and rear surface printing is then started. In the embodiment of the present invention, when performing the rear surface printing, desirably, immediately before carrying out the rear surface printing, at least the first sheet of the stack of front surface-printed paper sheets is inverted in the up/down or left/right direction so as to invert the front/rear surfaces of the paper again, and the paper is supplied and conveyed with the same surface (first surface) facing upwards as when printing the front surface. The number of sheets of paper which have been inverted again in this way (the number of sheets of paper supplied in the same front/rear orientation as when printing the front surface), and the direction of inversion thereof, are registered in the print control system. This number of sheets (a prescribed number of sheets) is then simply passed along the print conveyance path without performing printing on the image area thereof.

The expansion-contraction reference marks 22A to 22H on the front surface are read in by the in-line sensor during this conveyance of the paper, and the relative positional relationship between the expansion-contraction reference marks 22A to 22H (the relative distances between the marks) is determined and the amount of deformation due to expansion and contraction of the paper is measured. The image data for rear surface printing is then subjected to deformation processing (expansion and contraction processing) in accordance with the amount of deformation due to expansion and contraction thus determined, and image printing on the second surface is carried out.

(*a*) of FIG. 2 shows a paper sheet immediately after front surface printing, and (*b*) of FIG. 2 shows the paper sheet immediately before rear surface printing. Here, an example is described in which front surface-printed paper has contracted during a paper storage time period after front surface printing and before starting rear surface printing. In (*a*) and (*b*) of FIG. 2, a state is shown in which the paper has contracted in the left/right direction of the paper, but the paper also deforms due to expansion and contraction in the longitudinal direction of the paper (the paper conveyance direction).

The amount of deformation due to expansion and contraction of the paper varies with the image content printed on the front surface (the distribution of ink volume) and with the ambient storage conditions and the storage time after front surface printing. Furthermore, the extent of expansion and contraction varies respectively in the longitudinal direction and the lateral direction of the paper. The positional relationship (relative positions) of the expansion-contraction reference marks 22 recorded on the paper change with the deformation due to expansion and contraction of the paper. Consequently, before performing rear surface printing, the expansion-contraction reference marks 22 on the paper are read in by the in-line sensor, the positions thereof are measured, and hence the amount of change in the mark positions can be identified from the measurement results.

The displacement (amount of change) from the initial mark positions reflects the expansion and contraction of the paper. Since there is a correlation between the amount of expansion/ contraction of the paper and the amount of change in the positions of the expansion-contraction reference marks 22, then it is possible to determine the amount of expansion and contraction of the paper from the imaging results of the expansion-contraction reference marks 22.

For example, it is possible to determine the amount of expansion and contraction in the paper width direction (x direction) from the difference between the initial value $W_{U0}$ of the point-to-point distance between the expansion-contraction reference marks 22A and 22B, and the value ($W_{U1}$) determined from the imaging results. Similarly, it is possible to determine the amount of expansion and contraction in the paper conveyance direction (y direction) from the difference between the initial value $L_{L0}$ of the point-to-point distance between the expansion-contraction reference marks 22A and 22C, and the value ($L_{L1}$) of the imaging results. From the expansion-contraction reference marks 22 formed in the four corners of the image forming region 12, it is possible to ascertain the aspect of deformation of the rectangular paper by respectively measuring the point-to-point distance ($W_{U1}$) in the lateral direction of the upper side of the paper, the point-to-point distance ($W_{B1}$) in the lateral direction of the lower side of the paper, the point-to-point distance ($L_{L1}$) in the longitudinal direction of the left-hand side of the paper, and the point-to-point distance ($L_{R1}$) in the longitudinal direction of the right-hand side of the paper.

By comparing the interval between the expansion-contraction reference marks 22A and 22B, and the interval between the expansion-contraction reference marks 22C and 22D, the interval between 22G and 22H, the interval between 22A and 22C, the interval between 22E and 22F, and the interval between 22B and 22D, it is possible to judge whether the shape is a deformation extending uniformly in the width direction, or a trapezoid deformation, or rhomboid deformation.

Processing for correcting the image data to be printed on the rear surface (image shaping including enlargement or reduction of the image) is carried out in accordance with the amount of expansion and contraction of paper ascertained in this way. The processing is carried out to correct the mode of the image in accordance with deformation of the paper, such as applying a suitable magnification rate each in the vertical direction (x direction) and the lateral direction (y direction) of the paper.

The calculation sequence including "positional information of expansion-contraction reference marks", "ascertaining amount of expansion and contraction of paper" and "image correction" (i.e. calculating "positional information of expansion-contraction reference marks"→"ascertaining amount of expansion and contraction of paper"→"image correction" in sequence), may employ a look-up table (LUT), or the like, and in terms of an actual calculation processing algorithm, can be condensed into the input/output relationship based on "positional information of expansion-contraction reference marks" and "image correction" (i.e. relationship based on "positional information of expansion-contraction reference marks"→"image correction").

Below, a specific printing method is described in further detail.

Printing Method According to First Embodiment

As stated previously, by passing a set number of sheets of paper of which the printing has been carried out on the front surface only, along the printing conveyance path, and moving the paper directly below the in-line sensor, an image of the ejection failure detection pattern 20 (see FIG. 4) and the expansion-contraction reference marks 22 that have been used when printing is performed on the front surface are captured by the in-line sensor. By this means, it is possible to identify the positions of the expansion-contraction reference marks, at the resolution of the in-line sensor, and the amount of expansion and contraction can be measured.

More specifically, when outputting a front surface image, an image of the expansion-contraction reference marks 22 provided at the four corners of the image forming region 12 and between the four corners of the image forming region 12 in a central position in the width direction (left/right direction) and in a central position in the conveyance direction (up/down direction), are captured by the in-line sensor, and the amount of expansion and contraction of the paper in the up/down and left/right directions is measured. The amount of expansion and contraction in the paper conveyance direction is determined from the imaging cycle of the in-line sensor and the clock frequency of the conveyance encoder. By reducing the conveyance speed during imaging by the in-line sensor and raising the reading resolution of the in-line sensor in the conveyance direction, it is possible to improve the measurement accuracy of the expansion-contraction reference marks in the conveyance direction.

By identifying the positions of the expansion-contraction reference marks 22 by capturing images of the expansion-contraction reference marks 22 by the in-line sensor, it is possible to measure the amount of expansion and contraction of the paper with the lateral resolution and longitudinal resolution of the in-line sensor. The amount of expansion and contraction in the paper width direction (left/right direction) and the conveyance direction (up/down direction) is determined by means of at least the expansion-contraction reference marks 22 which are provided in the four corners (four points) to the outer side of the image formation region 12, and image printing closer to the front image can be achieved by applying expansion or contraction processing to the original image data for rear surface printing.

FIG. 3 is a flowchart showing steps for achieving a printing method according to a first embodiment. The flowchart shown in FIG. 3 is realized as an operation of the inkjet printer.

Step 1:

Firstly, an output image (print target image) is formed on the image forming region 12 of the paper 10 by executing a print job of the output image that is an object for printing, as well as printing an ejection failure detection pattern 20 onto the upper side blank margin portion (14A) of the image area (12). Furthermore, expansion-contraction reference marks 22 are printed in the four corners of the image area (12), the centers, in the width direction, of the upper end and the lower end, and the centers, in the conveyance direction, of the left-hand end and the right-hand end, and the printing on the front surface (corresponding to the "first surface") is thereby completed (S101).

The front surface printing is carried out continuously in accordance with print job instructions, and a plurality of printed objects that have been printed on the front surface are obtained (these printed objects are called "front surface-printed paper" below, and correspond to a "first surface-printed image formation medium"). The front surface-printed paper sheets obtained in this way are stacked successively on an output side, and stored as a stack of printed objects of a suitable number (for example, in units of approximately 1000 sheets).

Step 2:

After front surface printing has been completed, in order to carry out printing of the rear surface (corresponding to a "second surface"), the stack of front surface-printed paper is gathered together (united) and inverted in the front/rear surface direction (S102). In this step, it is also possible to invert the paper so that the paper is inverted in terms of the left/right direction and/or in terms of the up/down direction. It is also possible for an operator to invert the paper manually, but the task of inverting the paper may be automated by using an inverting apparatus equipped with a rotary mechanism.

In this way, a stack of paper (front surface-printed paper) which has been inverted in the front/rear surface direction is obtained. When performing rear surface printing, this paper stack is set in the paper supply unit (print tray) of the inkjet printer.

Step 3:

Next, when printing on the rear surface (unprinted surface) of the front surface-printed paper is performed, a prescribed number of sheets including at least the first sheet of the paper stack which has been printed on the front surface is inverted in the up/down or left/right direction, and is then set in the paper supply unit (print tray) with the printed front surface facing upwards (S103). The task of inverting this prescribed number of sheets can be performed manually by an operator or may be automated by providing an inverting mechanism in the paper supply unit or the paper storage unit.

Step 4:

At least the uppermost (first) sheet of paper of the stack of front surface-printed paper set in the paper supply unit has the same front/rear surface orientation as when the front surface (first surface) print is output (a state where the printed surface is facing upwards and the paper is effectively (practically) not inverted). The paper is passed and conveyed along the conveyance path of the printer (S104). This front surface-printed paper is simply conveyed and inkjet image formation is not performed thereon.

Step 5:

An image of the expansion-contraction reference marks 22 on the front surface-printed paper which has been conveyed is captured by the in-line sensor which is situated in the paper conveyance path of the printer (S105). It is possible to determine the positional information of the expansion-contraction reference marks 22 (the relative positional relationship of the marks), from the read data obtained by the in-line sensor (the image signal obtained by the imaging operation). In this step, it is possible to identify the expansion-contraction reference marks 22 at the resolution of the in-line sensor.

Step 6:

The respective amounts of expansion and contraction in the up/down direction and the left/right direction of the paper are measured from the positional information of the expansion-contraction reference marks 22 thus determined (S106). The amount of expansion and contraction is calculated on the basis of the difference between the positions (initial positions) of the expansion-contraction reference marks 22 when printing on the front surface is performed (immediately after printing) and the positions (measurement values) of the expansion-contraction reference marks 22 before the start of rear surface printing (immediately before starting printing) which are identified in step 5. The information about the initial positions of the expansion-contraction reference marks 22 during front surface printing can be ascertained previously in the printer as data during printing. In other words, it can be known in advance which nozzles have been used to print the expansion-contraction reference marks 22 when printing on the front surface is carried out. Alternatively, this information is stored in a memory as "initial position information", on the basis of information read by the in-line sensor during paper conveyance in the front surface printing operation.

Therefore, it is possible to determine the amount of expansion and contraction from the difference between the positional information of the expansion-contraction reference marks obtained by the imaging in Step 5 and the initial positional information. This amount of expansion and contraction is converted into an amount indicating how much the paper has expanded or contracted, in units of the recording nozzle pitch of the inkjet bar head (the nozzle pitch corresponding to the recording resolution).

Step 7:

On the basis of the amount of expansion and contraction determined in Step 6, expansion and contraction correction is applied to the image data for rear surface printing, so as to match the deformation due to expansion and contraction of the paper (S107). This correction processing is applied to the original image data before half-toning. The image data which has been corrected (corrected for expansion and contraction) in accordance with the deformation due to expansion and contraction is subjected to the half-toning processing, and is converted into dot data. This dot data is ejection control data which controls ejection from each nozzle.

Step 8:

Rear surface printing is carried out on the basis of the image data obtained in Step 7 which has undergone correction for expansion and contraction (S108). When rear surface printing is started, the front surface-printed paper is supplied continuously from the paper supply unit, and rear surface printing is carried out continuously.

Further Printing Methods

In the method according to the first embodiment described above, it is possible to determine the expansion and contraction in the paper conveyance direction and the paper width direction with a resolution up to the resolution of the in-line sensor (for example, 51 μm, 14800 pixels, on the paper surface). A method is now described where it is possible to measure the expansion and contraction with greater accuracy than the resolution of the in-line sensor.

If the imaging resolution of the in-line sensor is smaller than the image formation resolution of the inkjet bar head (print head), and it is wished to raise the measurement accuracy in order to correct expansion and contraction further, then data obtained by capturing an image of the ejection failure detection pattern 20 is used.

Description of Ejection Failure Detection Pattern

FIG. 4 is an enlarged diagram showing one example of an ejection failure determination pattern. In order that the droplet ejection results of the respective nozzles in the inkjet bar head can be distinguished clearly from those of the other nozzles, line patterns corresponding to the respective nozzles are formed as shown in FIG. 4, for example. The number of lines is reduced in the illustration, for the sake of convenience.

The ejection failure detection pattern 20 shown in FIG. 4 is a so-called "1-on n-off" type line pattern. In one line head, if nozzle numbers are assigned in order from the end in the paper width direction (x direction) to the sequence of nozzles which constitute a nozzle row aligned effectively in one row following the x direction (the effective nozzle row obtained by orthogonal projection), then the nozzle groups each of which performs ejection simultaneously are divided up on the basis of the remainder "B" produced when the nozzle number is divided by an integer "A" of not less than 2 (B=0, 1, . . . A−1), and a 1-on n-off type of line pattern such as that shown in FIG. 4 is obtained by forming line groups produced by continuous droplet ejection from respective nozzles while altering the droplet ejection timing for each group of nozzle numbers: AN+0, AN+1, . . . , AN+B (where N is an integer not less than 0).

FIG. 4 shows an example where A=11 and B=1 to 10. In other words, the first-step line block shown in FIG. 4 is a line block formed by simultaneous droplet ejection from nozzles having nozzle numbers expressed by "11N+0", such as the nozzle numbers 11, 22, 33, . . . (a block of a group of lines formed by nozzles having nozzle numbers corresponding to multiples of 11).

The second-step line block is a line block formed by droplet ejection from nozzle numbers "11N+10", such as nozzle numbers 10, 21, 32, and so on. The same applies to the third-step and subsequent line blocks; for example, the eleventh-step line block is a line block formed by droplet ejection from nozzle numbers "11N+1", such as nozzle numbers 1, 12, 23, 34, and so on.

In the present embodiment, an example where A=11 is shown, but in general, the formula AN+B (B=0, 1, . . . , A−1) can be applied, where A is an integer not less than 2.

By using a 1-on n-off test pattern of this kind, there is no overlap between mutually adjacent lines within each line block, and it is possible respectively to form independent lines for all the nozzles (for each nozzle) which can be distinguished from the other nozzles. By using a test pattern (ejection failure detection pattern) such as that shown in FIG. 4, lines corresponding to ejection failure nozzles are missing, and therefore it is possible to identify the positions of the ejection failure nozzles.

Apart from a line pattern of a so-called "1-on, n-off" type described above, the test pattern may also include other patterns, such as other line blocks (for example, a block for confirming position error between line blocks) or horizontal lines (dividing lines) which divide between the line blocks, and the like. Furthermore, in the case of an inkjet printing apparatus having a plurality of heads of different ink colors, similar line patterns are formed for the heads corresponding to respective ink colors (for example, heads corresponding to the respective colors of C, M, Y and K).

Here, since the region of the non-image portion (blank margin portion) on the recording medium 124 is limited, then it may not be possible to form line patterns (test charts) for all of the nozzles in all of the heads of the respective colors, in the blank margin portion of one sheet of recording medium 124. In cases of this kind, a test pattern is divided among a plurality of sheets of recording media 124 and formed thereon.

Printing Method According to Second Embodiment

There follows a description of an example of a printing method which employs a method of improving the reading accuracy of expansion-contraction reference marks by using an ejection failure detection pattern that has been recorded during front surface printing.

The steps of printing on the front surface, obtaining a stack of sheets of front surface-printed paper, gathering the paper stack together and inverting the front/rear surfaces in a lump sum are the same as in the first embodiment. Thereupon, when rear surface printing is to be performed (and desirably, immediately before rear surface printing), a prescribed number of sheets including at least the first one sheet of the stack of front surface-printed paper are inverted in the up/down or left/right direction and set in the paper supply unit (print tray) with the printed front surface facing upwards, and a new expansion-contraction reference pattern is recorded additionally on the front surface. In this step, the new expansion-contraction reference marks (second marks) which are additionally recorded are formed by the same nozzles as the expansion-contraction reference marks (first marks) formed during the front surface printing, in respect of the paper width direction (x direction), and are formed in a blank margin portion at positions which avoid overlap with the first marks as much as possible, in respect of the conveyance direction (y direction), for example, between the ejection failure detection pattern and the first marks.

Below, for the sake of convenience, the respective marks are distinguished by calling the expansion-contraction reference marks recorded during front surface printing "first expansion-contraction reference marks" and calling the new expansion-contraction reference marks recorded additionally before rear surface printing "second expansion-contraction reference marks".

By comparing the second expansion-contraction reference pattern which is formed here (additionally recorded) with the ejection failure detection pattern and the first expansion-contraction reference pattern formed during front surface printing, it is possible to determine the amount of expansion and contraction at a resolution close to the resolution of the recording nozzle pitch. The second expansion-contraction reference marks may be recorded at the same positions as the first expansion-contraction reference marks (by the same nozzles and the same droplet ejection timing) and investigate the differences between the both marks, or the second expansion-contraction reference marks may be recorded at positions shifted by a predetermined specific amount (known amount) from the first expansion-contraction reference marks. In the latter case, since the amount (specific amount) by which the recording position is shifted between the first expansion-contraction reference marks and the second expansion-contraction reference marks can be ascertained in advance, then it is possible to determine the amount of deviation caused by expansion and contraction of the paper, from the deviation between the specific amount and the mark positions which are actually captured.

When measuring how much difference there is between the positions at which the first expansion-contraction reference marks and the second expansion-contraction reference marks have been recorded on the paper, the ejection failure detection pattern formed during front surface printing (during printing of the first expansion-contraction reference marks) is used.

Firstly, similarly to the printing method of the first embodiment, it is judged according to the pixel value of the in-line sensor how far the second expansion-contraction reference pattern has deformed due to expansion and contraction in the paper width direction.

Next, in order to measure the amount of expansion and contraction in greater detail, the top step (group) to the bottom step (group) of the ejection failure detection pattern formed during printing on the front surface are examined in sequence, and the step number of the ejection failure detection pattern that has a phase and a pixel value closest to the phase and pixel value of the ejection failure detection pattern from the end of a second expansion-contraction reference mark formed newly is determined. After the closest step number of the ejection failure detection pattern is determined, the accuracy is raised above the pixel pitch of the in-line sensor (for example, approximately 51 μm in the case of 500 dpi) and the positions of the expansion-contraction reference marks can be determined in units of the recording nozzle pitch (for example, approximately 21.2 μm in the case of 1200 dpi).

FIG. 5 is a graph of the pixel values obtained by capturing an image of the first-step to fifth-step line blocks and the expansion-contraction reference marks. Furthermore, FIG. 6 is a graph of the pixel values obtained by capturing images of the sixth-step to eleventh-step line blocks. The horizontal axis in FIG. 5 and FIG. 6 indicates the pixel of the in-line sensor (the pixel position), and the vertical axis is the digital value of the signal. A pixel value of 255 on the vertical axis represents white (no ink density) and a pixel value of 0 represents black (ink density). In other words, FIG. 5 and FIG. 6 are density data profiles in the paper width direction of the in-line sensor (the direction of alignment of the photosensitive pixels).

A longitudinal line and a lateral line in each of the expansion-contraction reference marks intersect to form a cross-shape, and if the signal profile (see FIG. 5) obtained by capturing an image of the longitudinal line is compared with the phase of the image signal of the ejection failure detection pattern, then it can be seen which line belonging to which step number of the ejection failure detection pattern is close to the position of the longitudinal line of an expansion-contraction reference mark. For example, in the case of FIG. 5, it can be seen that the longitudinal line of the expansion-contraction reference mark is close to the second step, or the third step or the fourth step of the ejection failure detection pattern.

In FIG. 5, since the pixel value of the expansion-contraction reference mark is "172/255", the pixel value of the second step of the ejection failure detection pattern is "175/255", the pixel value of the third step of the ejection failure detection pattern is "172/255", and the pixel value of the fourth step of the ejection failure detection pattern is "168/255", then it can be inferred that the position of the expansion-contraction reference mark is recorded by a nozzle in the third step.

Furthermore, if the step number of the ejection failure detection pattern can be inferred, then since there is a one-to-one relationship between the ejection failure detection pattern and the nozzle numbers, it is possible to identify the nozzle position corresponding to the position of the expansion-contraction reference mark.

It is ascertained which nozzles are used to record the first expansion-contraction reference marks, during their recording, (this information is saved as data). On the other hand, in the case of the second expansion-contraction reference marks, it is possible to ascertain the positions on the paper in association with the nozzle positions in the inkjet bar head, from the image signal captured by the in-line sensor.

As described above, if the number of the step of the ejection failure detection pattern having a pixel value matching the pixel value of the expansion-contraction reference mark is determined, then it is possible to identify the nozzle number corresponding to that step number. By using the pixel value representing the image density level of the ejection failure detection pattern, and the phase information thereof, it is possible to determine the amount of deformation due to expansion and contraction (the amount of expansion and contraction) with greater detail than the imaging pixel pitch of the in-line sensor.

According to the measurement principle described above, it is possible to measure the amount of deformation due to expansion and contraction in the time period from the printing of the first expansion-contraction reference marks and the capturing of an image thereof by the in-line sensor until the printing of the second expansion-contraction reference marks and the capturing of an image thereof, by using the ejection failure detection pattern formed as a 1-on n-off pattern (see FIG. 4) as a measurement scale. In this way, it is possible to measure an amount of expansion and contraction which is not greater than the pixel pitch of the in-line sensor.

FIG. 7 is a flowchart showing steps for achieving a printing method according to the second embodiment. The flowchart shown in FIG. 7 is realized as an operation of the inkjet printer.

Steps S201 to S203 in FIG. 7 are similar to steps S102 to S103 in FIG. 3. Steps S204 to S209 are as follows.

Step 4:

At least the uppermost (first) sheet of paper of the stack of front surface-printed paper set in the paper supply unit has the same front/rear surface orientation as when the front surface (first surface) print is output (a state where the printed surface is facing upwards and the paper is effectively (practically) not inverted). The paper is supplied to the printer and new expansion-contraction reference marks (second expansion-contraction reference marks) only are printed onto the surface which has already been printed (S204).

These second expansion-contraction reference marks are recorded additionally in portions (in free portions) which avoid overlap with the ejection failure detection pattern and the first expansion-contraction reference marks.

Step 5:

In Step 4 described above, an image of the second expansion-contraction reference marks which are newly formed in the four corners of the paper and in central positions in the longitudinal and lateral directions, and the ejection failure detection pattern which is formed during the front surface printing, is captured by the in-line sensor which is situated in the paper conveyance pattern (S205).

Step 6:

The read data obtained from the in-line sensor (an image signal obtained by imaging) is analyzed (in analysis processing), and the straight lines in the conveyance direction of the second expansion-contraction reference marks (longitudinal lines) and the step numbers of the ejection failure detection pattern having the closest phase are determined in mutually associated fashion, in sequence from the top step to the bottom step (S206).

Step 7:

The amount of expansion and contraction of the paper is measured in units of the recording nozzle pitch, on the basis of the longitudinal line of a second expansion-contraction reference mark and the closest step number of the ejection failure detection pattern (S207).

S208 (Step 8) to S209 (Step 9) are the same as S107 to S108 in FIG. 3.

In the case of this second embodiment (FIG. 7), if the distance between the first expansion-contraction reference marks recorded a first time and second expansion-contraction reference marks which are newly recorded additionally is large and is greater than the pixel pitch of the in-line sensor, then it is possible to judge the circumstances of the expansion-contraction reference marks from the read image of the in-line sensor. The distance between the first expansion-contraction reference marks and the second expansion-contraction reference marks is judged on the basis of the read image of the in-line sensor, and if this distance is greater than the sensor pixel pitch, then premised on the fact that the respective expansion-contraction reference marks are distanced in this way, an accurate distance is measured by referring to the ejection failure detection pattern. On the other hand, if the results of judgment of the reading image indicate that the distance between the first expansion-contraction reference marks and the second expansion-contraction reference marks is not greater than the sensor pixel pitch, then this distance cannot be measured by comparing the pixels of the in-line sensor, and therefore processing is carried out to measure the amount of deformation (the distance between two expansion-contraction reference marks) more accurately by referring to the information about the ejection failure detection pattern shown in FIG. 4 to FIG. 6.

Example of Composition of Inkjet Printing Apparatus

FIG. 8 is a general schematic drawing showing an example of the composition of an inkjet printing apparatus relating to an embodiment of the present invention. The inkjet printing apparatus 100 according to the present embodiment is principally constituted by a paper supply unit 112, a treatment liquid deposition unit (pre-coating unit) 114, an image formation unit 116, a drying unit 118, a fixing unit 120 and a paper output unit 122. The inkjet printing apparatus 100 is an inkjet image forming apparatus using a single pass method, which forms a desired color image by ejecting droplets of inks of a plurality of colors from inkjet heads 172M, 172K, 172C and 172Y onto a recording medium 124 (corresponding to an "image formation medium", also called "paper" below for the sake of convenience) held on a pressure drum (image formation drum 170) of an image formation unit 116. The inkjet printing apparatus 100 is a drop-on-demand (DOP) type of image forming apparatus employing a two-liquid reaction (aggregation) method in which an image is formed on a recording medium 124 by depositing a treatment liquid (here, an aggregating treatment liquid) on a recording medium 124 before ejecting droplets of ink, and causing the treatment liquid and ink liquid to react together.

Paper Supply Unit

Cut sheet recording media 124 are stacked in the paper supply unit 112 and each recording medium 124 is supplied, one sheet at a time, to the treatment liquid deposition unit 114, from a paper supply tray 150 of the paper supply unit 112. In the present embodiment, cut sheet paper (cut paper) is used as the recording medium 124, but it is also possible to adopt a composition in which paper is supplied from a continuous roll (rolled paper) and is cut to a required size.

Treatment Liquid Deposition Unit

The treatment liquid deposition unit 114 is a mechanism which deposits a treatment liquid onto a recording surface of the recording medium 124. The treatment liquid includes a coloring material aggregating agent which aggregates the coloring material (in the present embodiment, the pigment) in the ink deposited by the image formation unit 116, and the separation of the ink into the coloring material and the solvent is promoted due to the treatment liquid and the ink making contact with each other.

The treatment liquid deposition unit 114 includes a paper supply drum 152, a treatment liquid drum (also called "pre-coat drum") 154 and a treatment liquid application apparatus 156. The treatment liquid drum 154 includes a hook-shaped gripping device (gripper) 155 provided on the outer circumferential surface thereof, and is devised in such a manner that the leading end of the recording medium 124 can be held by gripping the recording medium 124 between the hook of the holding device 155 and the circumferential surface of the treatment liquid drum 154. The treatment liquid drum 154 may include suction holes provided in the outer circumferential surface thereof, and be connected to a suctioning device which performs suctioning via the suction holes. By this means, it is possible to hold the recording medium 124 tightly against the circumferential surface of the treatment liquid drum 154.

A treatment liquid application apparatus 156 is provided opposing the circumferential surface of the treatment liquid drum 154, to the outside of the drum 154. The treatment liquid application apparatus 156 includes a treatment liquid vessel in which the treatment liquid is stored, an annex roller (measuring roller) which is partially immersed in the treatment liquid in the treatment liquid vessel, and a rubber roller which transfers a dosed amount of the treatment liquid to the recording medium 124, by being pressed against the annex roller and the recording medium 124 on the treatment liquid drum 154. According to this treatment liquid application apparatus 156, it is possible to apply the treatment liquid to the recording medium 124 while dosing the amount of the treatment liquid. Instead of the roller application method, various methods such as the spray method and the inkjet method can be implemented.

The recording medium 124 onto which the treatment liquid has been deposited by the treatment liquid deposition unit 114 is transferred from the treatment liquid drum 154 to the image formation drum 170 of the image formation unit 116 via the intermediate conveyance unit 126.

Image Formation Unit

The image formation unit 116 includes an image formation drum 170 (also called "jetting drum"), a paper pressing roller 174, and inkjet heads 172M, 172K, 172C and 172Y. Similarly to the treatment liquid drum 154, the image formation drum 170 includes a hook-shaped holding device (gripper) 171 on the outer circumferential surface of the drum. The recording medium 124 held on the image formation drum 170 is conveyed with the recording surface thereof facing to the outer side, and ink is deposited onto this recording surface from the inkjet heads 172M, 172K, 172C and 172Y.

Each of the inkjet heads 172M, 172K, 172C and 172Y is a full-line type (single-pass method) inkjet recording head having a nozzle row that enables the image formation over the entire area of the recordable width, and a nozzle row of nozzles (two-dimensionally arranged nozzles) for ejecting ink arranged throughout the whole width of the image forming region is formed in the ink ejection surface of each head. The inkjet heads 172M, 172K, 172Y and 172Y are each disposed so as to extend in a direction perpendicular to the conveyance direction of the recording medium 124 (the direction of rotation of the image formation drum 170).

Ink droplets of the respective inks are ejected from the inkjet heads 172M, 172K, 172C and 172Y toward the recording surface of the recording medium 124 which is held on the outer circumferential surface of the image formation drum 170.

The ink makes contact with the treatment liquid that has previously been deposited on the recording surface, and the coloring material (pigment) dispersed in the ink is aggregated to form a coloring material aggregate. As one possible example of a reaction between the ink and the treatment liquid, in the present embodiment, a mechanism is used whereby an acid is included in the treatment liquid and the consequent lowering of the pH breaks down the dispersion of pigment and causes the pigment to aggregate, and according to this mechanism, bleeding of the coloring material, intermixing between inks of different colors, and interference between ejected droplets due to combination of the ink droplets upon landing are avoided. In this way, flowing of coloring material, and the like, on the recording medium 124 is prevented and an image is formed on the recording surface of the recording medium 124.

The droplet ejection timings of the inkjet heads 172M, 172K, 172C and 172Y are synchronized with an encoder (not illustrated in FIG. 8; indicated by reference numeral 294 in FIG. 12) which is positioned with the image formation drum 170 and determines the speed of rotation. An ejection trigger signal (pixel trigger) is issued on the basis of this encoder determination signal. By this means, it is possible to specify the landing position with high accuracy. Moreover, speed variations caused by inaccuracies in the image formation drum 170, or the like, can be ascertained in advance, and the droplet ejection timings obtained by the encoder can be corrected, thereby reducing droplet ejection non-uniformities, irrespectively of inaccuracies in the image formation drum 170, the accuracy of the rotational axle, and the speed of the outer circumferential surface of the image formation drum 170.

Although the configuration with the CMYK standard four colors is described as an example in the present embodiment, combinations of the ink colors and the number of colors are not limited to those. As required, light inks, dark inks and/or special color inks can be added. For example, a configuration in which inkjet heads for ejecting light-colored inks such as light cyan and light magenta are added is possible. Moreover, there are no particular restrictions of the sequence in which the heads of respective colors are arranged.

The recording medium 124 onto which an image has been formed in the image formation unit 116 is transferred from the image formation drum 170 to the drying drum 176 of the drying unit 118 via the intermediate conveyance unit 128.

Drying Unit

The drying unit 118 is a mechanism which dries the water content contained in the solvent which has been separated by the action of aggregating the coloring material, and as shown in FIG. 8, includes a drying drum 176 and a solvent drying apparatus 178. Similarly to the treatment liquid drum 154, the drying drum 176 includes a hook-shaped holding device (gripper) 177 provided on the outer circumferential surface of the drum, in such a manner that the leading end of the recording medium 124 can be held by the holding device 177.

The solvent drying apparatus 178 is disposed in a position opposing the outer circumferential surface of the drying drum 176, and is constituted by a plurality of halogen heaters 180 and hot air spraying nozzles 182 disposed respectively between the halogen heaters 180. It is possible to achieve various drying conditions, by suitably adjusting the temperature and air flow volume of the hot air flow which is blown from the hot air flow spraying nozzles 182 toward the recording medium 124, and the temperatures of the respective halogen heaters 180.

By holding the recording medium 124 in such a manner that the recording surface thereof is facing outwards on the outer circumferential surface of the drying drum 176 (in other words, in a state where the recording surface of the recording medium 124 is curved in a convex shape), and drying while conveying the recording medium 124 in rotation, it is possible to prevent the occurrence of wrinkles and floating up of the recording medium 124, and therefore drying non-uniformities caused by these phenomena can be prevented reliably.

The recording medium 124 on which a drying process has been carried out in the drying unit 118 is transferred from the drying drum 176 to the fixing drum 184 of the fixing unit 120 via the intermediate conveyance unit 130.

Fixing Unit

The fixing unit 120 is constituted by a fixing drum 184, a halogen heater 186, a fixing roller 188 and an in-line sensor 190. Similarly to the treatment liquid drum 154, the fixing drum 184 includes a hook-shaped holding device (gripper) 185 provided on the outer circumferential surface of the drum, in such a manner that the leading end of the recording medium 124 can be held by the holding device 185.

By means of the rotation of the fixing drum 184, the recording medium 124 is conveyed with the recording surface facing to the outer side, and preliminary heating by the halogen heater 186, a fixing process by the fixing roller 188 and inspection by the in-line sensor 190 are carried out in respect of the recording surface.

The fixing roller 188 is a roller member for melting self-dispersing polymer micro-particles contained in the ink and thereby causing the ink to form a film, by applying heat and pressure to the dried ink, and is composed so as to heat and pressurize the recording medium 124. More specifically, the fixing roller 188 is disposed so as to press against the fixing drum 184, in such a manner that a nip is created between the fixing roller 188 and the fixing drum 184. By this means, the recording medium 124 is sandwiched between the fixing roller 188 and the fixing drum 184 and is nipped with a prescribed nip pressure (for example, 0.15 MPa), whereby a fixing process is carried out.

Furthermore, the fixing roller 188 is constituted by a heated roller formed by a metal pipe of aluminum, or the like, having good thermal conductivity, which internally incorporates a halogen lamp, and is controlled to a prescribed temperature (for example, 60° C. to 80° C.). By heating the recording medium 124 by means of this heating roller, thermal energy equal to or greater than the Tg temperature (glass transition temperature) of the latex contained in the ink is applied and the latex particles are thereby caused to melt. By this means, fixing is performed by pressing the latex particles into the undulations in the recording medium 124, as well as leveling the undulations in the image surface and obtaining a glossy finish.

In the embodiment shown in FIG. 8, only one fixing roller 188 is provided, but it is also possible to provide fixing rollers in a plurality of stages, in accordance with the thickness of the image layer and the Tg characteristics of the latex particles.

On the other hand, the in-line sensor 190 is a reading device for reading an image (including the ejection failure detection pattern and the expansion-contraction reference marks) recorded on the recording medium 124 so as to measure the ejection failure check pattern, image density and image failure, and, for example, a CCD line sensor is used as the sensor.

According to the fixing unit 120 having the composition described above, the latex particles in the thin image layer formed by the drying unit 118 are heated, pressurized and melted by the fixing roller 188, and hence the image layer can be fixed to the recording medium 124.

Instead of an ink which includes a high-boiling-point solvent and polymer micro-particles (thermoplastic resin particles), it is also possible to include a monomer which can be polymerized and cured by exposure to ultraviolet (UV) light. In this case, the inkjet printing apparatus 100 includes a UV exposure unit for exposing the ink on the recording medium 124 to UV light, instead of a heat and pressure fixing unit (fixing roller 188) based on a heat roller. In this way, if using an ink containing an active light-curable resin, such as an ultraviolet-curable resin, a device which radiates the active light, such as a UV lamp or an ultraviolet LD (laser diode) array, is provided instead of the fixing roller 188 for heat fixing.

Paper Output Unit

As shown in FIG. 8, a paper output unit 122 is provided subsequently to the fixing unit 120. The paper output unit 122 includes an output tray 192, and a transfer drum 194, a conveyance belt 196 and a tensioning roller 198 are provided between the output tray 192 and the fixing drum 184 of the fixing unit 120 so as to oppose same. The leading end portion of a recording medium 124 after printing is held by a gripper on a bar (not illustrated) which spans across the endless conveyance belt 196, the recording medium is conveyed above the output tray 192 due to the rotation of the conveyance belts 196, and the recording medium is stacked on the output tray 192.

Furthermore, although not shown in FIG. 8, the inkjet printing apparatus 100 according to the present embodiment includes, in addition to the composition described above, an ink storing and loading unit which supplies ink to the inkjet heads 172M, 172K, 172C and 172Y, and a device which supplies treatment liquid to the treatment liquid deposition unit 114, as well as including a head maintenance unit which carries out cleaning (nozzle surface wiping, purging, nozzle suctioning, and the like) of the inkjet heads 172M, 172K, 172C and 172Y, a position determination sensor which determines the position of the recording medium 124 in the paper conveyance path, a temperature sensor which determines the temperature of the respective units of the apparatus, and the like.

The image formation drum 170 corresponds to the "first conveyance device" and the paper conveyance system including the intermediate conveyance unit 128 to the fixing drum 184 situated after the image formation drum 170 (reference numerals 128, 176, 130, 184) correspond to the "second conveyance device". Furthermore, the in-line sensor 190 corresponds to the "imaging device".

Example of Composition of Inkjet Head

Next, the structure of the inkjet head will be described. The inkjet heads 172M, 172K, 172C and 172Y corresponding to the respective colors have a common structure, and therefore these heads are represented by a head indicated by the reference numeral 250 below.

FIG. 9A is a plan view perspective diagram showing an example of the structure of a head 250, and FIG. 9B is a partial enlarged view of same. FIGS. 10A and 10B are diagrams showing examples of the arrangement of a plurality of head modules which constitute a head 250. Furthermore, FIG. 11 is a cross-sectional diagram (a cross-sectional diagram along line 11-11 in FIGS. 9A and 9B) showing a composition of a droplet ejection element of one channel (an ink chamber unit corresponding to one nozzle 251) which forms a recording element unit (ejection element unit).

As shown in FIGS. 9A and 9B, the head 250 according to this embodiment has a structure in which a plurality of ink chamber units (droplet ejection elements) 253 are arranged two-dimensionally in a matrix configuration, each ink chamber unit including a nozzle 251 forming an ink ejection port, and a pressure chamber 252 corresponding to the nozzle 251, and the like, whereby a high density is achieved in the effective nozzle pitch (projected nozzle pitch) obtained by projecting (by orthogonal reflection) the nozzles to an alignment in the lengthwise direction of the head (the direction perpendicular to the paper conveyance direction).

In order to compose a nozzle row equal to or greater than a length corresponding to the full width of the image forming region of the recording medium 124 in a direction (the direction of arrow M; corresponding to the "x direction") which is substantially perpendicular to the conveyance direction of the recording medium 124 (the direction of arrow S; corresponding to the "y direction"), a long line type head is composed by arranging short head modules 250' in a staggered configuration as illustrated in FIG. 10A, each short head module having a plurality of nozzles 251 arranged two-dimensionally. Alternatively, as shown in FIG. 10B, it is also possible to adopt a mode where head modules 250" are joined together in one row.

The full line type print head for single-pass printing is not limited to a case where the image formation range is set to the whole surface of the recording medium 124, and if one portion of the surface of the recording medium 124 is set as the image formation range, then a nozzle row required for image formation within the prescribed image formation range should be desirably formed.

A pressure chamber 252 provided to each nozzle 251 has substantially a square planar shape (see FIGS. 9A and 9B), and has an outlet port for the nozzle 251 at one of diagonally opposite corners and an inlet port (supply port) 254 for receiving the supply of the ink at the other of the corners. The planar shape of the pressure chamber 252 is not limited to this embodiment and can be various shapes including quadrangle (rhombus, rectangle, etc.), pentagon, hexagon, other polygons, circle, and ellipse.

As illustrated in FIG. 11, the head 250 is configured by stacking and joining together a nozzle plate 251A in which the nozzles 251 are formed, a flow channel plate 252P in which the pressure chambers 252 and the flow channels including the common flow channel 255 are formed, and the like. The nozzle plate 251A constitutes a nozzle surface (ink ejection surface) 250A of the head 250 and has formed therein the two-dimensionally arranged nozzles 251 communicating respectively to the pressure chambers 252.

The flow channel plate 252P constitutes lateral side wall parts of each pressure chamber 252 and serves as a flow channel formation member which forms a supply port 254 as a limiting part (the narrowest part) of the individual supply channel leading the ink from the common flow channel 255 to each pressure chamber 252. FIG. 11 is simplified for the convenience of explanation, and the flow channel plate 252P may be structured by stacking one or more substrates.

The nozzle plate 251A and the flow channel plate 252P can be made of silicon and formed in the prescribed shapes by means of the semiconductor manufacturing process.

The common flow channel 255 is connected to an ink tank (not shown), which is a base tank for supplying ink, and the ink supplied from the ink tank is delivered through the common flow channel 255 to each pressure chamber 252.

Piezoelectric actuators 258 (piezoelectric element) each having an individual electrode 257 are joined onto the diaphragm 256 constituting a part of faces (the ceiling face in FIG. 11) of the pressure chambers 252. The diaphragm 256 in the present embodiment is made of silicon having a nickel (Ni) conductive layer serving as a common electrode 259 corresponding to lower electrodes of the piezoelectric actuators 258, and also serves as the common electrode of the piezoelectric actuators 258 which correspond to the respective pressure chambers 252. The diaphragm can be formed by a non-conductive material such as resin; and in this case, a common electrode layer made of a conductive material such as metal is formed on the surface of the diaphragm member. It is also possible that the diaphragm is made of metal (an electrically-conductive material) such as stainless steel (SUS) which also serves as the common electrode.

When a drive voltage is applied to an individual electrode 257, the corresponding piezoelectric actuator 258 is deformed, the volume of the corresponding pressure chamber 252 is thereby changed, and the pressure in the corresponding pressure chamber 252 is thereby changed, so that the ink inside the corresponding pressure chamber 252 is ejected through the corresponding nozzle 251. When the displacement of the corresponding piezoelectric actuator 258 is returned to its original state after the ink is ejected, new ink is refilled in the corresponding pressure chamber 252 from the common flow channel 255 through the corresponding supply port 254.

As illustrated in FIG. 9B, the plurality of ink chamber units 253 having the above-described structure are arranged in a prescribed matrix arrangement pattern in a line direction along the main scanning direction and a column direction not perpendicular to the main scanning direction and oblique at a fixed angle of θ with respect to the main scanning direction, and thereby the high density nozzle head is achieved in the present embodiment. In this matrix arrangement, the nozzles 251 can be regarded to be equivalent to those substantially arranged linearly at a fixed pitch $P=L_s/\tan\theta$ in the main scanning direction, where $L_s$ represents a distance between the nozzles adjacent in the sub-scanning direction.

In implementing the present invention, the mode of arrangement of the nozzles 251 in the head 250 is not limited to the embodiments in the drawings, and various nozzle arrangement structures can be employed. For example, instead of the matrix arrangements as described in FIGS. 9A and 9B, it is also possible to use, a V-shaped nozzle arrangement, or an undulating nozzle arrangement, such as zigzag configuration (W-shape arrangement) which repeats units of V-shaped nozzle arrangements.

The devices which generate pressure (ejection energy) applied to eject droplets from the nozzles in the inkjet head are not limited to the piezoelectric actuators (piezoelectric elements), and can employ various pressure generation devices (ejection energy generation devices), such as heaters in a thermal system (which uses the pressure resulting from film boiling by the heat of the heaters to eject ink), and various actuators in other systems such as electrostatic actuators. Energy generation devices which are properly based on the ejection system employed in the head are arranged in the flow channel structure body.

Description of Control System

FIG. 12 is a principal block diagram showing a system composition of the inkjet printing apparatus 100. The inkjet printing apparatus 100 includes: a communication interface 270, a system controller 272, a print controller 274, an image buffer memory 276, a head driver 278, a motor driver 280, a heater driver 282, a treatment liquid deposition control unit 284, a drying control unit 286, a fixing control unit 288, a memory 290, a ROM 292, an encoder 294, and the like.

The communication interface 270 is an interface unit for receiving image data sent from a host computer 350. A serial interface such as USB (Universal Serial Bus), IEEE1394, Ethernet (registered trademark), and wireless network, or a parallel interface such as a Centronics interface may be used as the communication interface 270. A buffer memory (not shown) may be mounted in this portion in order to increase the communication speed. The image data sent from the host computer 350 is received by the inkjet printing apparatus 100 through the communication interface 270, and is temporarily stored in the memory 290.

The memory 290 is a storage device for temporarily storing images inputted through the communication interface 270, and data is written and read to and from the image memory 274 through the system controller 272. The memory 290 is not limited to a memory composed of semiconductor elements, and a hard disk drive or another magnetic medium may be used.

The system controller 272 is constituted of a central processing unit (CPU) and peripheral circuits thereof, and the like, and it functions as a control device for controlling the whole of the inkjet printing apparatus 100 in accordance with a prescribed program, as well as a calculation device for performing various calculations. More specifically, the system controller 272 controls the various sections, such as the communication interface 270, print controller 274, motor driver 280, heater driver 282, treatment liquid deposition control unit 284, and the like, as well as controlling communications with the host computer 350 and writing and reading to and from the memory 290, and it also generates control signals for controlling the motor 296 of the conveyance system and the heater 298.

Programs to be executed by the CPU of the system controller 272 and various data required for control purposes are stored in the ROM 292. The ROM 292 stores print control data for an ejection failure detection pattern and print control data for expansion-contraction reference marks. The ROM 292 may be a non-rewriteable storage device, or may be a rewriteable storage device such as an EEPROM. The memory 290 is used as a temporary storage area for image data and also serves as a development area for programs and a calculation work area for the CPU.

The motor driver 280 is a driver which drives the motor 296 in accordance with instructions from the system controller 272. In FIG. 12, various motors arranged in the respective units of the apparatus are represented by the reference numeral 296. For example, the motor 296 shown in FIG. 12 includes motors which drive the rotation of the paper supply drum 152, the treatment liquid drum 154, the image formation drum 170, the drying drum 176, the fixing drum 184, the transfer drum 194, and the like, a drive motor of the pump for negative pressure suctioning from the suction holes of the image formation drum 170, a motor of a withdrawal mechanism which moves the head units to a maintenance area apart from the image formation drum 170, and the like, illustrated in FIG. 8.

The heater driver 282 is a driver which drives the heater 298 in accordance with instructions from the system controller 272. In FIG. 12, various heaters arranged in the respective units of the apparatus are represented by the reference numeral 298. For example, the heaters 298 shown in FIG. 12 include a pre-heater (not illustrated) for previously heating the recording medium 124 to a suitable temperature in the paper supply unit 112.

The print controller 274 is a control unit which has signal processing functions for carrying out processing, correction, and other treatments in order to generate a print control signal on the basis of the image data in the memory 290, in accordance with the control of the system controller 272, and which supplies the print data (dot data) thus generated to the head driver 278.

In general, the dot data is generated by subjecting the multiple-tone image data to color conversion processing and halftone processing. The color conversion processing is processing for converting image data represented by sRGB, for instance (for example, 8-bit image data for each color of RGB), into image data of the respective colors of ink used by the inkjet image printing apparatus 100 (KCMY color data, in the present embodiment).

Half-tone processing is processing for converting the color data of the respective colors generated by the color conversion processing, into dot data of respective colors (in the present embodiment, KCMY dot data) by error diffusion or a threshold matrix method, or the like.

Required signal processing is carried out in the print controller 274, and the ejection volume and the ejection timing of the ink droplets in the head 250 are controlled via the head driver 278 on the basis of the obtained dot data. By this means, a desired dot size and dot arrangement can be achieved.

An image buffer memory 276 is provided in the print controller 274, and data, such as image data and parameters, is stored temporarily in the image buffer memory 276 during processing of the image data in the print controller 274. Furthermore, also possible is a mode in which the print controller 274 and the system controller 272 are integrated to form a single processor.

To give a general description of the processing from image input until print output, the image data that is to be printed is input via the communication interface 270 from an external source and is stored in the memory 290. At this stage, for example, RGB image data is stored in the memory 290. In the inkjet printing apparatus 100, an image having tones which appear quasi-continuous to the human eye is formed by altering the droplet ejection density and dot size of fine dots of ink (coloring material), and therefore it is necessary to convert the tones of the input digital image (light/dark density of the image) into a dot pattern which reproduces the tones as faithfully as possible. Therefore, data of the original image (RGB) accumulated in the memory 290 is sent to the print controller 274 via the system controller 272, and is converted into dot data for each ink color by a half-toning process using a threshold value matrix, error diffusion, or the like, in the print controller 274. In other words, the print controller 274 carries out processing for converting the input RGB image data into dot data for the four colors of K, C, M and Y. In this way, dot data generated by the print controller 274 is stored in the image buffer memory 276.

The head driver 278 outputs drive signals for driving the actuators corresponding to the respective nozzles of the head 250 on the basis of the print data supplied from the print controller 274 (in other words, dot data stored in the image buffer memory 276). The head driver 278 may also include a feedback control system for maintaining uniform drive conditions in the heads. In FIG. 12, the image buffer memory 276 is depicted as being attached to the print controller 274, but may also serve as the memory 290. Furthermore, also possible is a mode in which the print controller 274 and the system controller 272 are integrated to form a single processor.

By applying a drive signal output from the head driver 278 to the head 250 in this way, ink is ejected from a corresponding nozzle. An image is formed on a recording medium 124 by controlling ink ejection from the head 250 while conveying the recording medium 124 at a prescribed speed.

The treatment liquid deposition control unit 284 controls the operation of the treatment liquid application apparatus 156 (see FIG. 8) in accordance with instructions from the system controller 272. The drying control unit 286 controls the operation of the solvent drying apparatus 178 (see FIG. 8) in accordance with instructions from the system controller 272.

The fixing control unit 288 controls the operation of a fixing and pressurizing unit 299 which is constituted by the halogen heater 186 and the fixing roller 188 (see FIG. 8) of the fixing unit 120 in accordance with instructions from the system controller 272.

As shown in FIG. 8, the in-line sensor 190 is a block containing an image sensor, which reads in an image printed on the recording medium 124, determines the printing circumstances (the presence/absence of ejection, variation in droplet ejection, optical density, and the like) by carrying out required signal processing, and the like, and supplies the detection results to the system controller 272 and the print controller 274.

The print controller 274 performs various corrections (ejection failure correction, density correction, and the like) in relation to the head 250 on the basis of information obtained from the in-line sensor 190, as well as implementing control to perform cleaning operations (nozzle restoration operations), such as preliminary ejection, suctioning, wiping, and the like, in accordance with requirements.

The operating unit 310 forming a user interface is constituted by an input apparatus 312 for the operator (user) to make various inputs and a display unit (display) 313. The input apparatus 312 may employ various modes, such as a keyboard, mouse, touch panel, buttons, or the like. By operating the input apparatus 312, an operator can perform actions such as inputting print conditions, selecting the image quality mode, inputting and editing additional information, searching for information, and the like, and can confirm various information such as input content, search results, and the like, via the display on the display unit 313. This display unit 313 also functions as a device which displays warnings, such as error messages.

FIG. 13 is a principal block diagram relating to image correction processing which uses the measurement results of the expansion-contraction reference marks. In FIG. 13, elements which are the same as elements shown in FIG. 12 are labeled with the same reference numerals.

As shown in FIG. 13, imaging data from the in-line sensor 190 is stored in a memory 320. The memory 320 stores read image data obtained by capturing an image of the ejection failure detection pattern 20 and the expansion-contraction reference marks 22. The memory 320 may use a storage region of the memory 290 described in relation to FIG. 12, or may be a separate memory. Furthermore, the memory 320 may be a memory which is incorporated into the system controller 272.

The system controller 272 includes an ejection failure nozzle detection processing unit 322, an ejection failure correction coefficient calculation unit 324 and an ejection failure correction coefficient storage unit 326. The ejection failure nozzle detection processing unit 322 carries out calculational processing to generate data about the positions of ejection failure nozzles and landing position error, and data indicating the density distribution (density data), and the like, from imaging data for the ejection failure detection pattern 20 read in by the in-line sensor 190, so as to carry out a processing for identifying ejection failure nozzles.

The ejection failure correction coefficient calculation unit 324 calculates a density correction coefficient for compensating for image quality deterioration due to the effects of ejection failure nozzles by means of other normally functioning nozzles. The ejection failure correction coefficient calculation unit 324 is able to calculate the correction coefficient by also referring to information about the measured landing position error and information about the density distribution. The data about the correction coefficient determined by the ejection failure correction coefficient calculation unit 324 is stored in an ejection failure correction coefficient storage unit 326.

Furthermore, the system controller 272 includes an expansion-contraction reference mark measurement processing unit 332, an amount of deformation due to expansion and contraction calculation unit 334, an expansion and contraction correction coefficient calculation unit 335, and an expansion and contraction correction coefficient storage unit 336. The expansion-contraction reference mark measurement processing unit 332 carries out signal processing for identifying the positions of the expansion-contraction reference marks on the paper, from the imaging data of the expansion-contraction reference marks read in by the in-line sensor 190. The amount of deformation due to expansion and contraction calculation unit 334 calculates the amount of deformation due to expansion and contraction in the up/down direction and the left/right direction of the paper, on the basis of the measured positional information for the expansion-contraction reference marks. The expansion and contraction correction coefficient calculation unit 335 determines a correction coefficient for deforming an image for printing in accordance with the deformation due to expansion and contraction, on the basis of the calculated amount of deformation due to expansion and contraction. The data about the correction coefficient determined by the expansion and contraction correction coefficient calculation unit 335 is stored in an expansion and contraction correction coefficient storage unit 336.

The expansion and contraction correction coefficient storage unit 336 can use a portion of the memory area of the ejection failure correction coefficient storage unit 326. For example, it is also possible to use a portion of the storage region of the memory 290 or the ROM 292 illustrated in FIG. 12 as the expansion and contraction correction coefficient storage unit 336 and the ejection failure correction coefficient storage unit 326.

The print controller 274 includes an ejection failure correction processing unit 328 and a deformation due to expansion and contraction correction processing unit 338. The ejection failure correction processing unit 328 is a processing device which carries out calculation for correcting the pixel values (density values) of the image data of an image for printing, by using a correction coefficient (ejection failure correction coefficient) stored in the ejection failure correction coefficient storage unit 326. When printing, correction by the ejection failure correction processing unit 328 is carried out on the image data for printing (original data) which is stored in the memory 290. The ejection failure correction processing unit 328 carries out correction to increase or decrease the density data of the pixel positions corresponding to normally functioning nozzles in the vicinity of an ejection failure nozzle, on the basis of the ejection failure correction coefficient, in such a manner that an output image is obtained in which recording defects caused by ejection failure nozzles are not readily visible. The image data referred to here (original data before correction) may be image data converted for each ink color, or may be RGB input image data before conversion for each ink color.

The inkjet printing apparatus 100 according to the present embodiment includes a function for carrying out correction of deformation due to expansion and contraction corresponding to the deformation due to expansion and contraction of the paper, before starting rear surface printing, in addition to the ejection failure correction function described above. In other words, the deformation due to expansion and contraction correction processing unit 338 is a processing device which uses correction coefficients (expansion and contraction correction coefficients) stored in the expansion and contraction correction coefficient storage unit 336 to carry out calculation for correcting the state of the image data of the image for printing (here, the data of the rear surface image to be printed on the second surface).

By means of this deformation due to expansion and contraction correction processing, the size and shape of the image for rear surface printing are corrected in accordance with the amount of expansion and contraction of the paper. When printing on the front surface (first surface), corrected image data 340 which has undergone the ejection failure correction processing described above is input to the half-tone processing unit 342. Furthermore, when printing on the rear surface (second surface), corrected image data 340 which has undergone deformation due to expansion and contraction correction processing and ejection failure correction processing is input to the half-tone processing unit 342.

The half-tone processing unit 342 is a signal processing device which converts the corrected image data (density data) into binary or multiple-value dot data. The half-toning device may employ commonly known methods of various kinds, such as an error diffusion method, a dithering method, a threshold value matrix method, a density pattern method, and the like. The half-toning process generally converts a tonal image data having M values ($M \geq 3$) into tonal image data having N values ($N < M$). In a simplest example, the image data is converted into dot image data having 2 values (dot on/dot off), but in such a half-toning process, it is also possible to perform quantization in multiple values which correspond to different types of dot size (for example, three types of dot: a large dot, a medium dot and a small dot).

The binary or multiple-value image data (dot data) obtained in this way is used for driving (on) or not driving (off) the respective nozzles, or in the case of multiple-value data, is used as ink ejection control data (droplet ejection control data) for controlling the droplet volume (dot size). The dot data (droplet ejection control data) generated by the half-tone processing unit 342 is supplied to the head driver 278 and the ink ejection operation of the head 250 is controlled.

Furthermore, the print controller 274 includes a drive waveform generation unit 344. The drive waveform generation unit 344 is a device which generates a drive voltage signal waveform for driving the piezo actuators 258 (see FIG. 11) corresponding to the respective nozzles 251 of the head 250. The waveform data of the drive voltage signal is stored previously in the ROM 292 (see FIG. 12) and waveform data to be used is output when required. The signal (drive waveform) generated by the drive waveform generation unit 344 is supplied to the head driver 278. The signal output from the drive waveform generation unit 344 may be digital waveform data or an analog voltage signal.

The inkjet image printing apparatus 100 shown in the present embodiment employs a drive method in which a common drive power waveform signal is applied to each piezo actuator 258 of the head 250 (head modules), in units of one module, and ink is ejected from the nozzles 251 corresponding to the respective piezo actuators 258 by turning switching elements (not illustrated) connected to the individual electrodes of the piezo actuators 258 on and off, in accordance with the ejection timing of the respective piezo actuators 258.

The processing functions of the ejection failure nozzle detection processing unit 322, the ejection failure correction coefficient calculation unit 324, the expansion-contraction reference mark measurement processing unit 332, the amount of deformation due to expansion and contraction calculation unit 334, the expansion and contraction correction coefficient calculation unit 335, the ejection failure correction processing unit 328, the deformation due to expansion and contraction correction processing unit 338, the half-tone processing unit 342, and the like, can be achieved by an ASIC or software, or a suitable combination thereof.

A combination of the ROM 292, the memory 290, the system controller 272 and the print controller 274 carries out the roles of the respective devices: the "test pattern print control device", the "ejection failure nozzle detection processing device", the "expansion-contraction reference mark printing control device", the "expansion-contraction deformation amount measurement device", the "image deformation processing device", the "print control device", the "expansion-contraction reference mark additional printing control device", and the "conveyance speed control device".

It is also possible to adopt a mode in which all or a portion of the processing functions performed by the ejection failure nozzle detection processing unit 322, the ejection failure correction coefficient calculation unit 324, the expansion-contraction reference mark measurement processing unit 332, the amount of deformation due to expansion and contraction calculation unit 334, the expansion and contraction correction coefficient calculation unit 335, the ejection failure correction processing unit 328, the deformation due to expansion and contraction correction processing unit 338, the half-tone processing unit 342, and the like, are installed in the host computer 350 (see FIG. 12).

Embodiment of In-Line Sensor (Image Reading Device)

FIG. 14 is a schematic drawing showing a composition of the in-line sensor 190. The in-line sensor 190 includes reading sensor units 374 which are arranged in parallel and read out the image on a recording medium. Each of the reading sensor units 374 is constituted integrally of: a line CCD 370 (corresponding to an "image reading device"); a lens 372 which forms an image on a light receiving surface of the line CCD 370; and a mirror 373 which bends the light path. The line CCD 370 has an array of color-specific photocells (pixels) provided with three-color RGB filters, and is able to read in a color image by means of RGB color separation. For example, next to each photo cell array of 3 RGB lines, there is provided a CCD analog shift register which respectively and independently transfers the charges of the even-numbered pixels and odd-numbered pixels in one line.

More specifically, it is possible to use a line CCD "μPD8827A" (product name) having a pixel (photocell) pitch of 9.325 μm, 7600 pixels×RGB, and a device length (width of sensor in direction of arrangement of photocells) of 70.87 mm, manufactured by NEC Electronics Corporation (or Renesas Electronics Corporation).

The line CCD 370 is fixed in a configuration where the direction of arrangement of the photocells is parallel to the axis of the drum on which the recording medium is conveyed.

The lens 372 is a lens of a condenser (scale-down) optics system which provides the image on a recording medium that is wrapped about the conveyance drum (indicated by reference numeral 184 in FIG. 8), at a prescribed rate of reduction. For example, if a lens which reduces the image to 0.19 times is employed, then an image of 373 mm width on the recording medium is provided onto the line CCD 370. In this case, the reading resolution on the recording medium is 518 dpi.

As illustrated in FIG. 14, the reading sensor units 374 each integrally having the line CCD 370, lens 372 and mirror 373 can be moved and adjusted in parallel to the axis of the conveyance drum, whereby the positions of the two reading sensor units 374 are adjusted and the respective reading sensor units 374 are disposed in such a manner that the images read by them are slightly overlapping. Furthermore, although not illustrated in FIG. 14, as an illumination device for determination, a xenon fluorescent lamp is disposed on the rear surface of a bracket 375, on the side of the recording medium, and a white reference plate is inserted periodically between the image and the illumination source so as to measure a white reference. In this state, the lamp is extinguished and a black reference level is measured.

The reading width of the line CCD 370 (the extent to which the determination can be performed in one action) can be designed variously in relation to the width of the image recording range on the recording medium. From the viewpoint of lens performance and resolution, for example, the reading width of the line CCD 370 is approximately ½ of the width of the image recording range (the maximum width which can be scanned (i.e. can be an inspection object).

The image data obtained by the line CCD 370 is converted into digital data by an A/D converter, or the like, and then stored in a temporary memory (indicated by reference numeral 320 in FIG. 13), whereupon the data is processed through the system controller 272 (see FIG. 12) and stored in the memory 290.

Actions and Beneficial Effects of the Embodiments of the Present Invention Described Above (1) It is possible to improve positional deviation between the front and rear surface images by correcting the rear surface printing data for expansion and contraction, in respect of expansion and contraction of the image after reading of the front surface image by the in-line sensor, for various different types of paper, even if there is variation in the ambient storage conditions and the storage time after front surface printing.

(2) In front surface printing, there is no need to use a special mechanism for capturing an image of or detecting the rear surface image or marks, etc. By using a printer having an in-line sensor which determines the quality of inkjet ejection, it is possible to align the rear surface image with the front surface image by means of a simple mechanism.

(3) If the paper expands or contracts after front surface printing, then it is possible to determine the amount of expansion and contraction at the imaging pixel pitch of the in-line sensor (according to the first embodiment). The amount of expansion and contraction of the paper can be measured at the imaging pixel pitch. By correcting the image data to be printed on the rear surface in respect of expansion and contraction, by the measured amount of expansion and contraction, it is possible to align the image positions on the front and rear surfaces.

(4) If, during rear surface printing, only expansion-contraction reference marks are recorded at the same width direction positions as the front surface, then by using the tone level information indicating which step of the ejection failure detection pattern has a pixel value matching an expansion-contraction reference mark, it is possible to measure the amount of expansion and contraction of the paper in greater detail than the imaging pixel pitch (with a precision close to the recording nozzle pitch) (according to the second embodiment).

Modification Examples

In the embodiments described above, an inkjet printing apparatus based on a method which forms an image by ejecting ink droplets directly onto the recording medium (direct recording method) is described, but the application of the present invention is not limited to this, and the present invention can also be applied to an image forming apparatus of an intermediate transfer type which provisionally forms an image (primary image) on an intermediate transfer body, and then performs final image formation by transferring the image onto recording paper in a transfer unit.

Furthermore, in the embodiments described above, an inkjet printing apparatus using a page-wide full-line type head having a nozzle row of a length corresponding to the full width of the recording medium (a single-pass image forming apparatus which completes an image by a single sub-scanning action) is described, but the application of the present invention is not limited to this and the present invention can also be applied to an inkjet printing apparatus which performs image recording by means of a plurality of head scanning (moving) actions while moving a short recording head, such as a serial head (shuttle scanning head), or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet printing apparatus comprising:

an inkjet head having nozzles which eject ink;

a first conveyance device which moves at least one of an image formation medium and the inkjet head during image formation by the inkjet head so as to cause relative movement of the image formation medium and the inkjet head;

a second conveyance device which conveys the image formation medium along a conveyance path after the image formation by the inkjet head;

an imaging device which is disposed in the conveyance path and captures an image of a print result recorded on the image formation medium;

a test pattern printing control device which controls ejection of the inkjet head in such a manner that an inspection test pattern for inspecting ejection quality of the inkjet head is recorded on the image formation medium;

an ejection failure nozzle detection processing device which identifies a position of an ejection failure nozzle of the inkjet head on a basis of information obtained by capturing an image of a print result of the inspection test pattern by the imaging device;

an expansion-contraction reference mark printing control device which controls ejection of the inkjet head so as to record expansion-contraction reference marks that form reference points for measuring a distance between at least two points, in a periphery outside an image forming region of a first surface of the image formation medium, when printing is performed on the first surface;

an expansion-contraction reference mark additional printing control device which implements control for supplying the at least one sheet of the first surface-printed image formation medium to an image formation unit of the inkjet head, prior to the printing on the second surface, and causing the inkjet head to record new expansion-contraction reference marks additionally on the at least one sheet of the first surface-printed image formation medium;

an expansion-contraction deformation amount measurement device which obtains information indicating an amount of deformation due to expansion and contraction of the image formation medium, from information obtained by conveying, by the second conveyance device, at least one sheet of a first surface-printed image formation medium whose first surface has already been printed, prior to printing on a second surface which is a rear surface of a print object obtained by the printing on the first surface, and capturing, by the imaging device, an image of the expansion-contraction reference marks and the new expansion-contraction reference marks recorded on the first surface of the at least one sheet of the first surface-printed image formation medium, before the printing is performed on an image forming region of the second surface after the printing on the first surface;

an image deformation processing device which applies image deformation processing corresponding to the amount of deformation due to expansion and contraction, to image data to be printed on the second surface, on a basis of the information indicating the amount of deformation due to expansion and contraction; and a print control device which carries out the printing on the second surface on a basis of the image data which has been corrected through the image deformation processing.

2. The inkjet printing apparatus as defined in claim 1, wherein the expansion-contraction reference marks are formed in four corners of the image forming region.

3. The inkjet printing apparatus as defined in claim 1, wherein the first conveyance device is a medium conveyance device which moves the image formation medium in cut sheet form.

4. The inkjet printing apparatus as defined in claim 1, wherein the inkjet head is a line type head based on a single-pass method.

5. The inkjet printing apparatus as defined in claim 1, wherein the image deformation processing device applies the image deformation processing to the image data before halftone processing.

6. The inkjet printing apparatus as defined in claim 1, wherein, without performing the image formation by the inkjet head, the at least one sheet of the first surface-printed image formation medium is conveyed by the first conveyance device and the second conveyance device and image capture of the expansion-contraction reference marks is performed by the imaging device.

7. The inkjet printing apparatus as defined in claim 1, wherein:

the inspection test pattern includes line patterns for the respective nozzles of the inkjet head whereby an ejection result of each nozzle can be identified and distinguished from other nozzles on the image formation medium; and the inspection test pattern is recorded in a blank margin portion outside the image forming region of the first surface, the at least one sheet of the first surface-printed image formation medium on which an image for printing has been printed in the image forming region of the first surface is supplied to the image formation unit of the inkjet head prior to the printing on the second surface, the new expansion-contraction reference marks are recorded additionally on the first surface of the at least one sheet of the first surface-printed image formation medium, and the amount of deformation due to expansion and contraction of the image formation medium is then measured in units of a nozzle pitch corresponding to a recording resolution of the inkjet head, by using information about pixel values of the inspection test pattern obtained by capturing an image of the inspection test pattern, the expansion-contraction reference marks, and the new expansion-contraction reference marks recorded on the first surface of the image formation medium.

8. The inkjet printing apparatus as defined in claim 7, wherein positions of nozzles corresponding to positions of the additionally recorded new expansion-contraction reference marks are identified from a correlation between a pixel value of a signal obtained by capturing an image of the new expansion-contraction reference marks, and a pixel value of a signal obtained by capturing an image of the inspection test pattern, and positional information of the new expansion-contraction reference marks is obtained from the recording resolution and the positions of the nozzles.

9. The inkjet printing apparatus as defined in claim 1, further comprising a conveyance speed control device which makes a conveyance speed of the at least one sheet of the first surface-printed image formation medium when the image of the expansion-contraction reference marks on the first surface is captured by the imaging device while the at least one sheet of the first surface-printed image formation medium is conveyed, slower than a conveyance speed of the at least one sheet of the first surface-printed image formation medium during the printing on the first surface and a conveyance speed of the at least one sheet of the first surface-printed image formation medium during the printing on the second surface.

10. A printing method of an inkjet printing apparatus including an inkjet head having nozzles for ejecting ink, a first conveyance device which moves at least one of an image formation medium and the inkjet head to cause relative movement of the image formation medium and the inkjet head during image formation by the inkjet head, a second conveyance device which conveys the image formation medium along a conveyance path after the image formation by the inkjet head, and an imaging device which is disposed in the conveyance path and captures an image of a print result formed on the image formation medium, the printing method comprising:

a test pattern printing step of recording an inspection test pattern for inspecting ejection quality of the inkjet head, on the image formation medium;

an ejection failure nozzle detection processing step of identifying a position of an ejection failure nozzle of the inkjet head on a basis of information obtained by capturing an image of a print result of the inspection test pattern by the imaging device;

an expansion-contraction reference mark printing step of recording expansion-contraction reference marks that form reference points for measuring a distance between at least two points, in a periphery outside an image forming region of a first surface of the image formation medium, when printing is performed on the first surface;

an expansion-contraction reference mark additional printing step which supplies the at least one sheet of the first surface-printed image formation medium to an image formation unit of the inkjet head, prior to the printing on the second surface, and causes the inkjet head to record new expansion-contraction reference marks additionally on the at least one sheet of the first surface-printed image formation medium, a first surface image printing step of carrying out the printing on an image forming region of the first surface;

an expansion-contraction reference mark imaging step of conveying, by the second conveyance device, at least one sheet of a first surface-printed image formation medium whose first surface has already been printed prior to printing on a second surface which is a rear surface of a print object obtained by the printing on the first surface, and capturing, by the imaging device, an image of the expansion-contraction reference marks and the new expansion-contraction reference marks recorded on the first surface of the at least one sheet of the first surface-printed image formation medium, before the printing is performed on an image forming region of the second surface after the printing on the first surface;

an expansion-contraction deformation amount measurement step of obtaining information indicating an amount of deformation due to expansion and contraction of the image formation medium from information obtained in the expansion-contraction reference mark imaging step;

an image deformation processing step of applying image deformation processing corresponding to the amount of deformation due to expansion and contraction, to image data to be printed on the second surface, on a basis of the information indicating the amount of deformation due to expansion and contraction; and a second surface image printing step of performing the printing on the image forming region of the second surface on a basis of the image data which has been corrected through the image deformation processing.

* * * * *